US005536094A

United States Patent [19]

Kondo

[11] Patent Number: 5,536,094

[45] Date of Patent: Jul. 16, 1996

[54] PROTECTIVE INK RIBBON UNIT HOLDER

[75] Inventor: Shinichi Kondo, Miyagi, Japan

[73] Assignee: Sony Corporation, Tokyo, Japan

[21] Appl. No.: 489,212

[22] Filed: Jun. 9, 1995

[30] Foreign Application Priority Data

Jun. 20, 1994 [JP] Japan ..... 6-137458
Dec. 8, 1994 [JP] Japan ..... 6-304966

[51] Int. Cl.[6] ..... B41J 35/28

[52] U.S. Cl. ..... 400/247; 400/207; 400/208.1; 206/393; 242/170

[58] Field of Search ..... 400/247, 191, 400/208.1, 237, 246, 250; 101/336; 206/393; 242/160.1, 160.2, 580, 586.2, 538.4, 170

[56] References Cited

U.S. PATENT DOCUMENTS 5,415,486 5/1995 Wouters ..... 400/693.1

5,480,242 1/1996 Gunderson ..... 400/208

*Primary Examiner*—Edgar S. Burr
*Assistant Examiner*—Daniel J. Colilla
*Attorney, Agent, or Firm*—Ronald P. Kananen

[57] ABSTRACT

An ink ribbon unit has supply and take-up spools which are fastened securely and locked against free rotation inexpensively and reliably in a manner not to impair the quality of an ink ribbon thereof. The supply and take-up spools are fastened securely and locked against free rotation by an elastic sheet-like holder which is formed by vacuum forming and has a fixed shape. The holder has a first holding portion for holding the take-up spool and a pair of second holding portions for holding diametrically opposite surfaces of the ink ribbon wound on the supply spool. The holder has free ends extending from the respective second holding portions and secured to each other by an adhesive tape.

9 Claims, 26 Drawing Sheets

PROTECTIVE INK RIBBON UNIT HOLDER

FIELD OF THE INVENTION

The present invention relates to an ink ribbon unit for use in a printer for printing a recorded image such as a recorded video image as a photographic image such as a color photographic image on a hard copy, and an ink ribbon cartridge for accommodating such an ink ribbon unit.

BACKGROUND OF THE INVENTION

Ink ribbon units for use in printers are composed of a supply spool with a coil of unused ink ribbon wound thereon and a take-up spool for winding a used ink ribbon thereon. In use, an ink ribbon unit that is housed in an ink ribbon cassette is set in a printer, which then prints a desired image on a photographic sheet of paper using the ink ribbon unit. Ink ribbon units themselves are commercially available in the market.

If the supply and take-up spools of an ink ribbon unit were freely rotatable of their own accord, then the ink ribbon would tend to become loose, making the ink ribbon unit less commercially valuable. To prevent the ink ribbon from being loosened, it has been customary to incorporate some means for fastening and locking the supply and take-up spools against free rotation.

Several conventional mechanisms for fastening and locking supply and take-up spools against free rotation will hereinafter be described below with reference to the drawings.

In FIG. 1 of the accompanying drawings, an ink ribbon unit 10 comprises a supply spool 1 with an unused ink ribbon 2 wound thereon, and a take-up spool 3 which winds the ink ribbon that has been consumed which has been supplied from the supply spool 1. The supply and take-up spools 1, 3 have on one end thereof respective driving side shafts 6, 7 having respective flanges 4, 5 at proximal ends thereof. The driving side shafts 6, 7 have respective circular drive holes 6*a*, 7*a* defined axially therein and respective sets of drive teeth 6*b*, 7*b* on their inner circumferential surfaces. The circular drive holes 6*a*, 7*a* serve to receive therein respective drive shafts (not shown) in a printer that are connected to an actuator such as a motor. When the drive shafts are received in the circular drive holes 6*a*, 7*a*, drive teeth on the drive shafts mesh with the drive teeth 6*b*, 7*b* to transmit drive forces to the supply and take-up spools 1, 3. The supply and take-up spools 1, 3 also have respective rotary side shafts 8, 9 on the other end thereof.

The ink ribbon unit 10 shown in FIG. 1 may be housed in an ink ribbon cassette which, as shown in FIG. 2 of the accompanying drawings, comprises a lower casing 50 and an upper casing 51 which are combined with each other. The lower casing 50 is somewhat tray-shaped and has on one end thereof a pair of transversely spaced driving side shaft bearings 52 with respective circular bearing holes 52*a* defined therein. The driving side shafts 6, 7 of the ink ribbon unit 10 are rotatably disposed in the respective bearing holes 52*a* in the driving side shaft bearings 52. The lower casing 50 also has on its other end a pair of transversely spaced rotary side shaft bearings 53 with respective U-shaped bearing slots 53*a* defined therein. The rotary side shafts 8, 9 of the ink ribbon unit 10 are rotatably disposed in the respective bearing slots 53*a* in the rotary side shaft bearings 53. An opening 54 for positional alignment with a print head (not shown) is defined in the lower casing 50 between its opposite ends.

The upper casing 51 is combined with the end of the lower casing 50 which has the rotary side shaft bearings 53. The upper casing 51 has a pair of spaced leaf springs 55 aligned respectively with the rotary side shaft bearings 53 for holding the rotary side shafts 8, 9 that are received respectively in the bearing slots 53*a*.

The ink ribbon unit 10 itself may be sold in different ways as described below.

FIG. 3 of the accompanying drawings shows one form in which the ink ribbon unit 10 is offered for sale. In FIG. 3, an adhesive tape 11 is applied to the ends of the driving side shafts 6, 7 of the ink ribbon unit 10 to fasten and lock the supply and take-up spools 1, 3 against free rotation.

FIG. 4 of the accompanying drawings shows another form in which the ink ribbon unit 10 is offered for sale. In FIG. 4, a rubber band 12 is placed around the ink ribbon unit 10 to fasten and lock the supply and take-up spools 1, 3 against free rotation.

The ink ribbon unit 10 may be offered for sale in still another form shown in FIG. 5 of the accompanying drawings. In FIG. 5, the ink ribbon unit 10 is placed in a transparent package bag 13 made of plastic or the like, and the package bag 13 is folded over on itself and fastened by an adhesive tape 13*a*. The supply and take-up spools 1, 3 thus contained in the package bag 13 and secured by the adhesive tape 13*a* are fastened and locked against free rotation.

The form shown in FIG. 3 has been disadvantageous in that it is difficult to apply the adhesive tape 11 precisely to the ends of the driving side shafts 6, 7 of the supply and take-up spools 1, 3, and the applied adhesive tape 11 tends to be peeled off because the rotary side shafts 8, 9 are free to rotate.

Problems with the ink ribbon unit 10 fastened by the rubber band 12 as shown in FIG. 4 are that the portion of the ink ribbon 2 which is engaged by the rubber band 12 is caused to wrinkle, and the wrinkles in the ink ribbon 2 are liable to lower the quality of an image printed using the ink ribbon 2.

The packaged ink ribbon unit 10 shown in FIG. 5 is costly because the package bag 13 itself and a process of packaging the ink ribbon unit 10 with the package bag 13 are additionally required.

SUMMARY OF THE INVENTION

It is therefore an object of the present invention to provide an ink ribbon unit having supply and take-up spools which are fastened securely and locked against free rotation inexpensively and reliably in a manner not to impair the quality of an ink ribbon thereof.

Still another object of the present invention is to provide an ink ribbon cartridge which allows an ink ribbon unit fastened by a sheet-like holder to be set easily therein.

According to an aspect of the present invention, there is provided an ink ribbon unit comprising a supply spool with an unused ink ribbon wound thereon, the supply spool having a driving side shaft on an end thereof, a rotary side shaft on an opposite end thereof, a take-up spool for winding a used ink ribbon supplied from the supply spool, the take-up spool having a driving side shaft on an end thereof, a rotary side shaft on an opposite end thereof, and means to hold the supply spool and the take-up spool parallel to each other, and to fasten and lock the supply spool and the take-up spool against free rotation, said means including a sheet-like elastic holder for surrounding an outer surface of the unused ink ribbon wound on the supply spool, said holder having free ends; and joint means for securing the free ends of the holder.

The supply spool and the take-up spool are held parallel to each other, with the free ends of the holder being secured to each other by the joint means. Therefore, the supply spool and the take-up spool are reliably fastened and locked against free rotation by the holder. Since the ink ribbon on the supply and take-up spools is protected in its entirety by the holder, the user can handle the ink ribbon unit without touching the ink ribbon.

According to another aspect of the present invention, there is also provided an ink ribbon cartridge comprising a supply spool with an unused ink ribbon wound thereon, the supply spool having a driving side shaft on an end thereof, a rotary side shaft on an opposite end thereof, a take-up spool for winding a used ink ribbon supplied from the supply spool, the take-up spool having a driving side shaft on an end thereof, a rotary side shaft on an opposite end thereof, and a cartridge casing formed by an upper half and a lower half, having a pair of driving side shaft bearings and a pair of rotary side shaft bearings, the driving side shafts of the supply and take-up spools being rotatably supported by the driving side shaft bearings, respectively, the rotary side shafts of the supply and take-up spools being rotatably supported by the rotary side shaft bearings, respectively, the supply and take-up spools being releasably fastened to each other, at least one of the driving side shafts of the supply and take-up spools having a first portion with a distance from an inner edge of a bearing hole to an outer edge of a flange of the bearing, which is greater than a dimension between outer circumferential surfaces of the driving side shafts at the time the supply and take-up spools are fastened to each other, and a second portion with a distance from the edge of the bearing hole to a flange of the bearing, which is equal to or smaller than the dimension.

While the supply and take-up spools are being fastened to each other around the surface of the ink ribbon, the driving side shaft of the supply spool can easily be inserted into the corresponding driving side shaft bearing of the cartridge casing. When the ink ribbon is delivered from the supply spool after the driving side shaft of the supply spool is inserted into the corresponding driving side shaft bearing, the driving side shaft of the take-up spool can be moved from the first portion of the driving side shaft bearing into a position on the outer circumferential surface of the driving side shaft bearing. After the supply spool is installed on the cartridge casing, the supply and take-up spools are released from each other, and the take-up spool is installed on the cartridge casing.

The above and other objects, features, and advantages of the present invention will become apparent from the following description of illustrative embodiments thereof to be read in conjunction with the accompanying drawings, in which like reference numerals represent the same or similar objects.

DETAILED DESCRIPTION OF THE PREFERRED EMBODIMENTS

Figure 1:
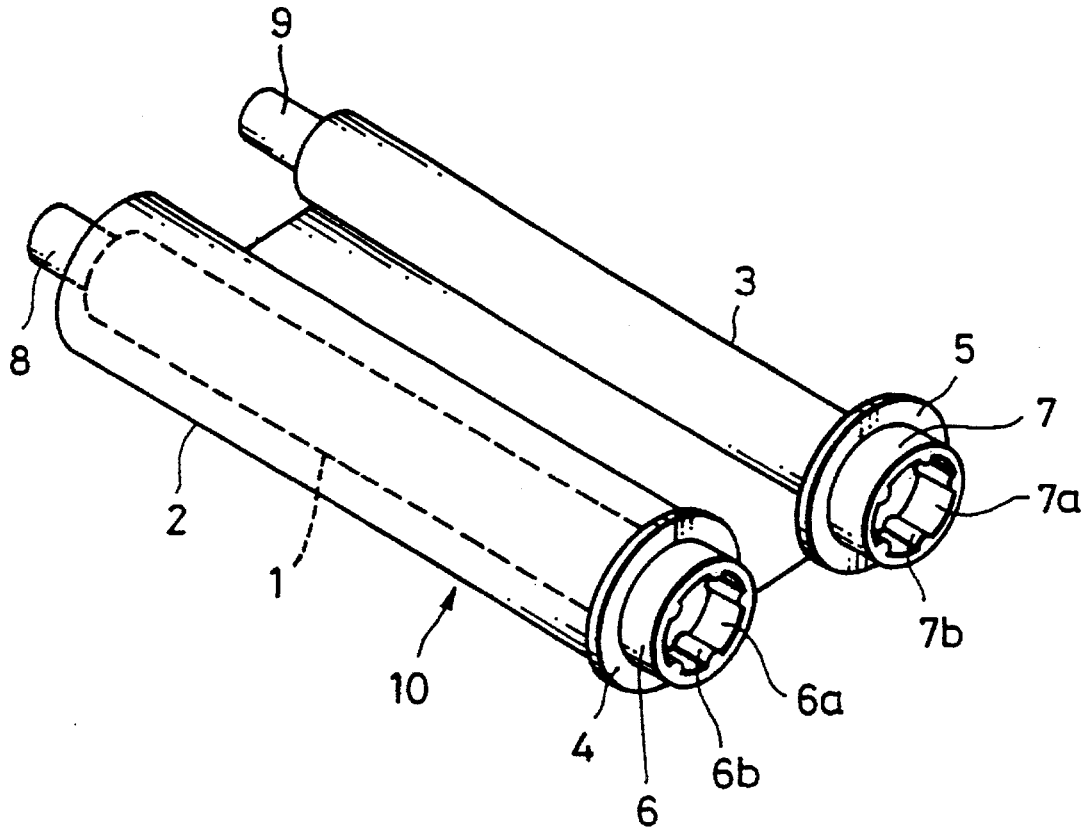
FIG. 1 is a perspective view of a conventional ink ribbon unit.
Figure 2:
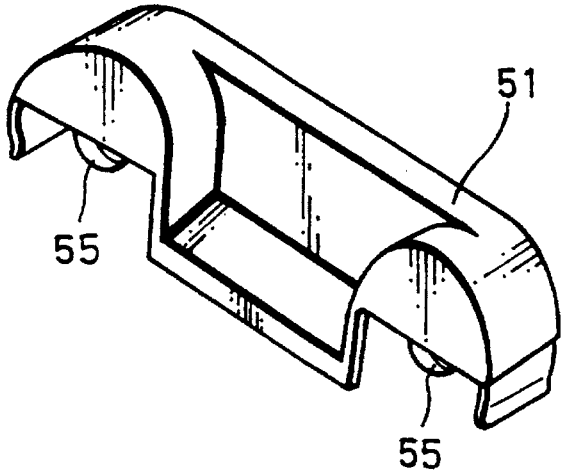
FIG. 2 is a perspective view of a conventional ink ribbon cartridge.
Figure 2:
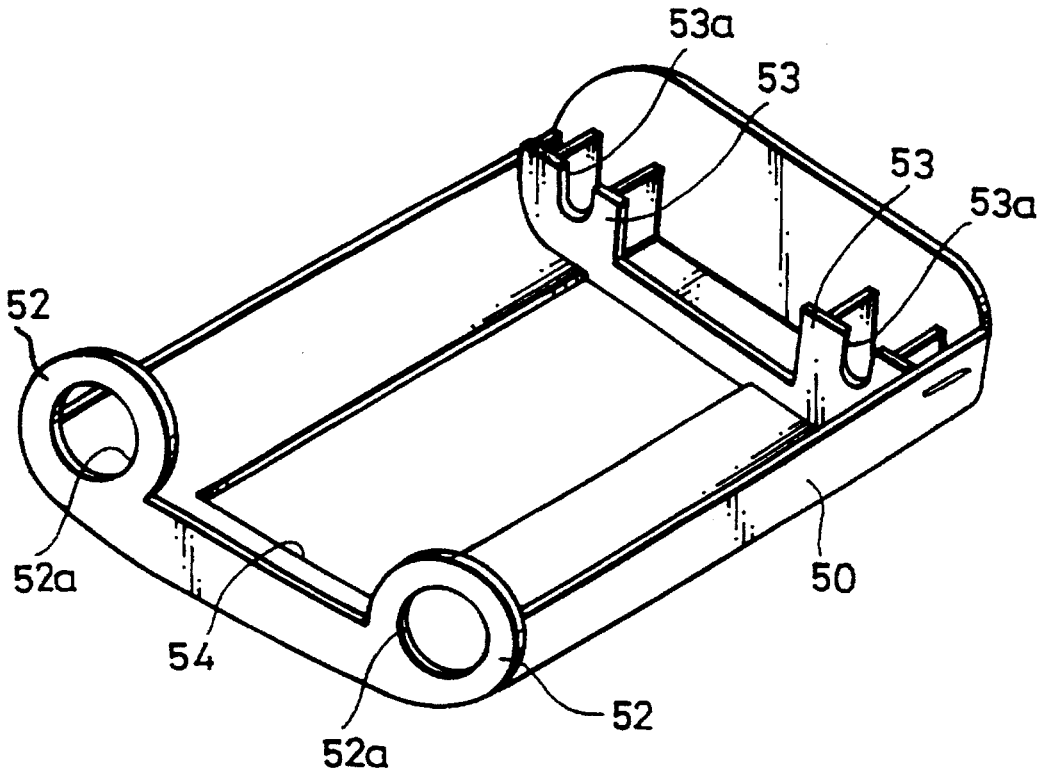
Figure 3:
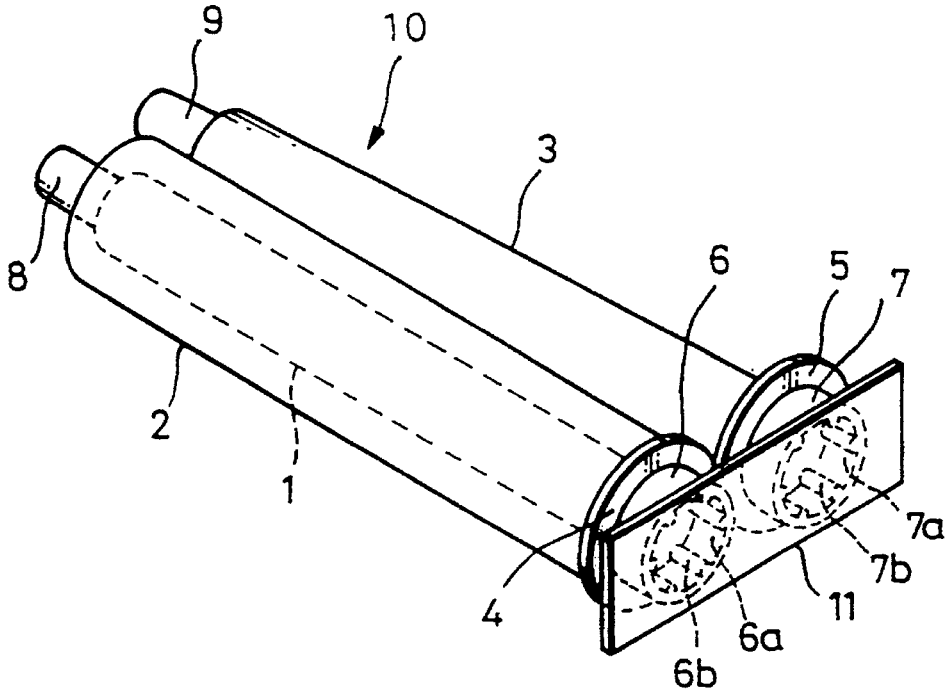
FIG. 3 is a perspective view of the conventional ink ribbon unit with a conventional means of fastening and locking supply and take-up spools against rotation.
Figure 4:
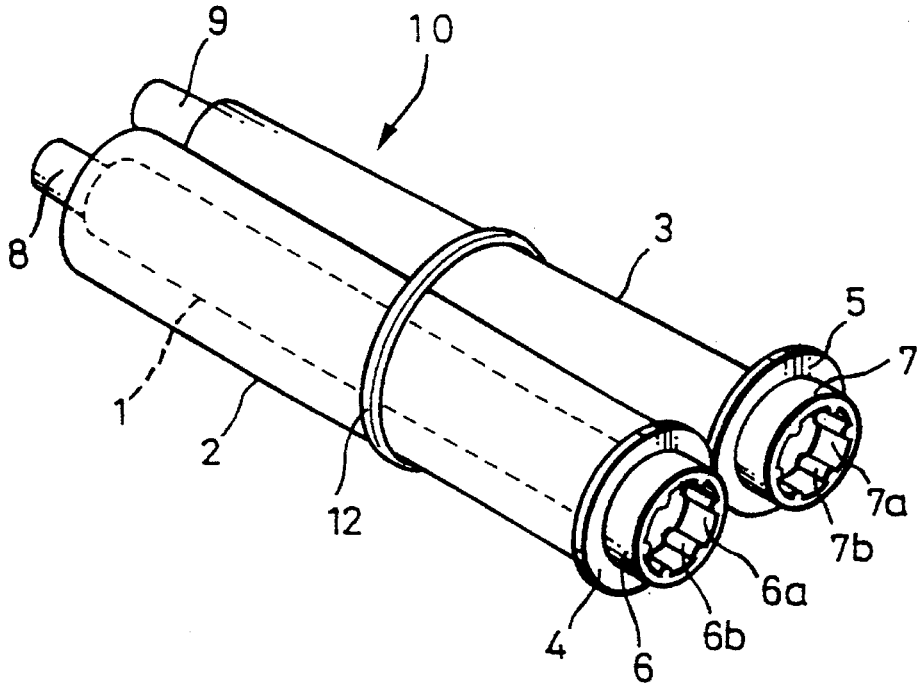
FIG. 4 is a perspective view of the conventional ink ribbon unit with another conventional means of fastening and locking supply and take-up spools against rotation.
Figure 5:
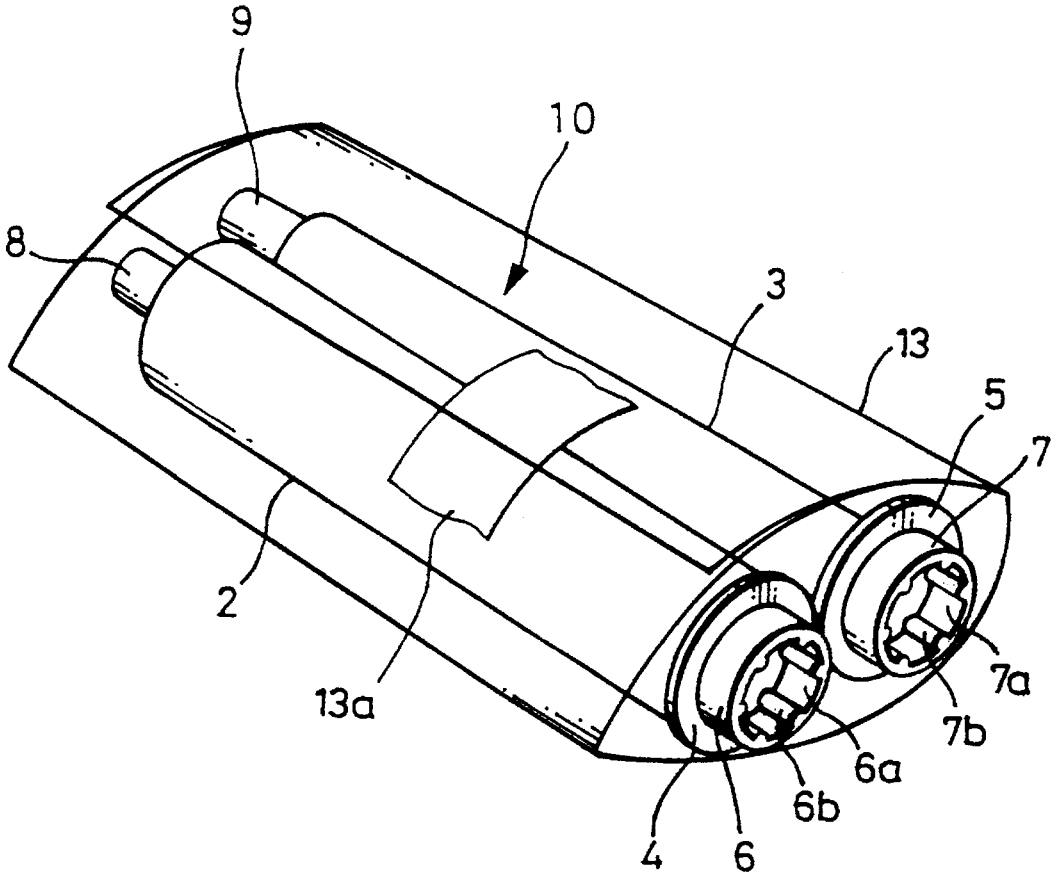
FIG. 5 is a perspective view of the conventional ink ribbon unit with still another conventional means of fastening and locking supply and take-up spools against rotation.

Like or corresponding parts are denoted by like or corresponding reference numerals throughout views.

Figure 6:
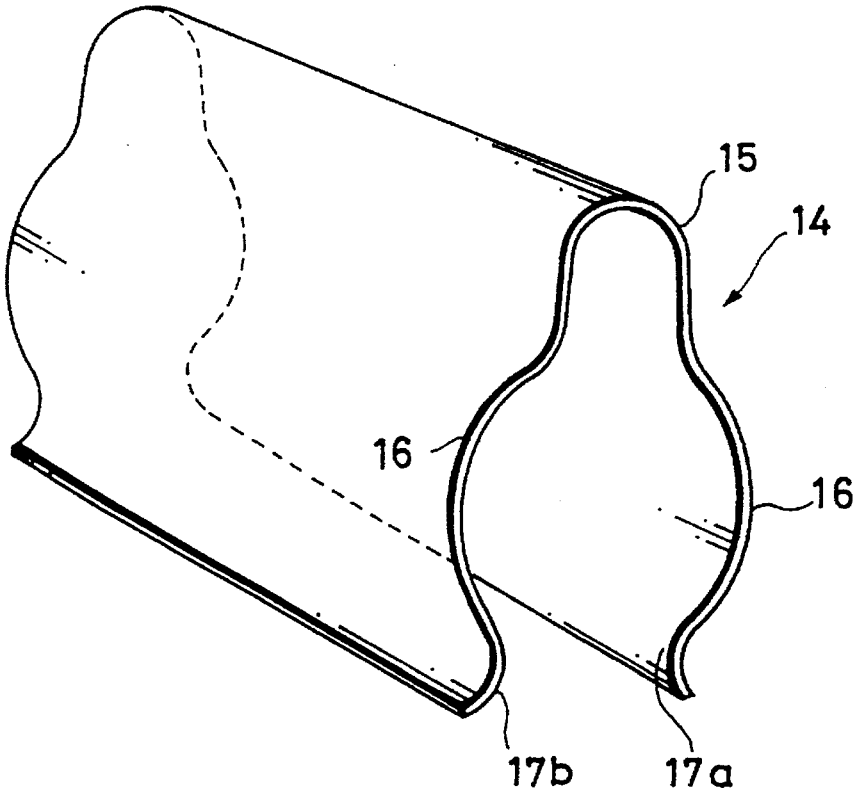
FIG. 6 is a perspective view of an ink ribbon unit and a holder according to a first embodiment of the present invention, the holder being shown as separate from the ink ribbon unit.
Figure 6:
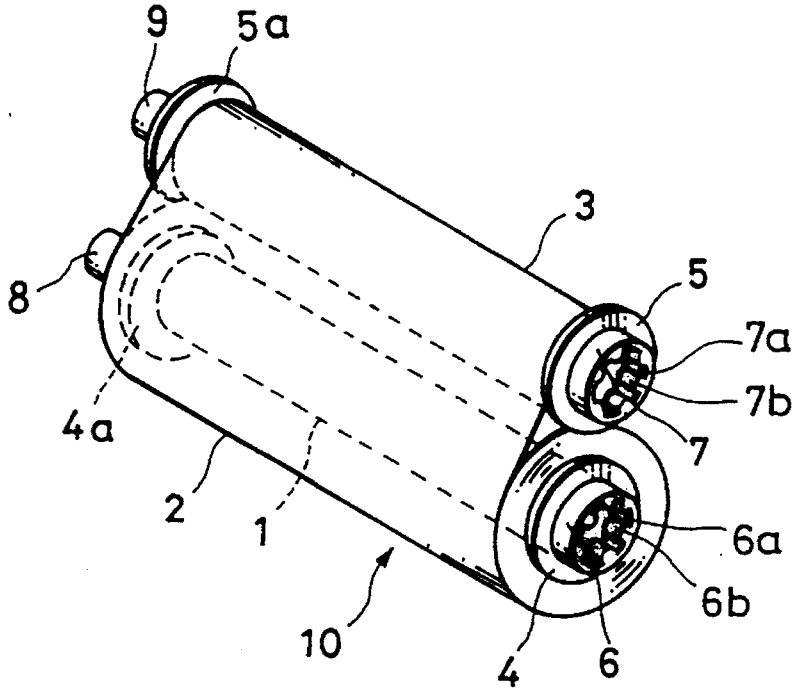

FIG. 6 shows an ink ribbon unit 10 and a holder 14 according to a first embodiment of the present invention, the holder being shown as separate from the ink ribbon unit.

As shown in FIG. 6, an ink ribbon unit 10 comprises a supply spool 1 with an unused ink ribbon 2 wound thereon, and a take-up spool 3 which winds the ink ribbon 2 that has been consumed which has been supplied from the supply spool 1. The supply and take-up spools 1, 3 have on one end thereof respective driving side shafts 6, 7 having respective flanges 4, 5 at proximal ends thereof. The driving side shafts 6, 7 have respective circular drive holes 6*a*, 7*a* defined axially therein and respective sets of drive teeth 6*b*, 7*b* on their inner circumferential surfaces. The circular drive holes 6*a*, 7*a* serve to receive therein respective drive shafts (not shown) in a printer that are connected to an actuator such as a motor. When the drive shafts are received in the circular drive holes 6*a*, 7*a*, drive teeth on the drive shafts mesh with the drive teeth 6*b*, 7*b* to transmit drive forces to the supply and take-up spools 1, 3. The supply and take-up spools 1, 3 also have on the other end thereof respective rotary side shafts 8, 9 having respective flanges 4*a*, 5*a* at proximal ends thereof.

The supply spool 1 with the unused ink ribbon 2 wound thereon and the take-up spool 3 are put together, and fastened and locked against free rotation by a holder 14 which holds the supply and take-up spools 1, 3 therein. The holder 14 comprises a curved sheet of a plastic material such as PP (polypropylene), PET (polyethylene terephthalate), or the like, and is formed to shape by vacuum forming. The formed holder 14 has a certain degree of pliability and elasticity.

The vacuum forming process for forming the holder 14 may be a sheet forming process, a pressure forming process, a vacuum bag molding process, a straight forming process, or a drape forming process.

The formed holder 14 comprises a first holding portion 15 positioned at a bent corner thereof for holding the take-up spool 3 throughout the entire axial length thereof except for the shafts 7, 9 and the flanges 5, 5*a*, and a pair of outwardly curved second holding portions 16 contiguous to the first holding portion 15 and spaced from each other in a confronting relation for holding diametrically opposite surfaces of the ink ribbon 2 on the supply spool 1 throughout the entire axial length of thereof except for the shafts 6, 8 and the flanges 4, 4*a*. The holder 14 also has free opposite end portions extending respectively from the second holding portions 16 and outwardly curved as respective curled portions 17*a* , 17*b*, which define a slot therebetween.

Figure 7:
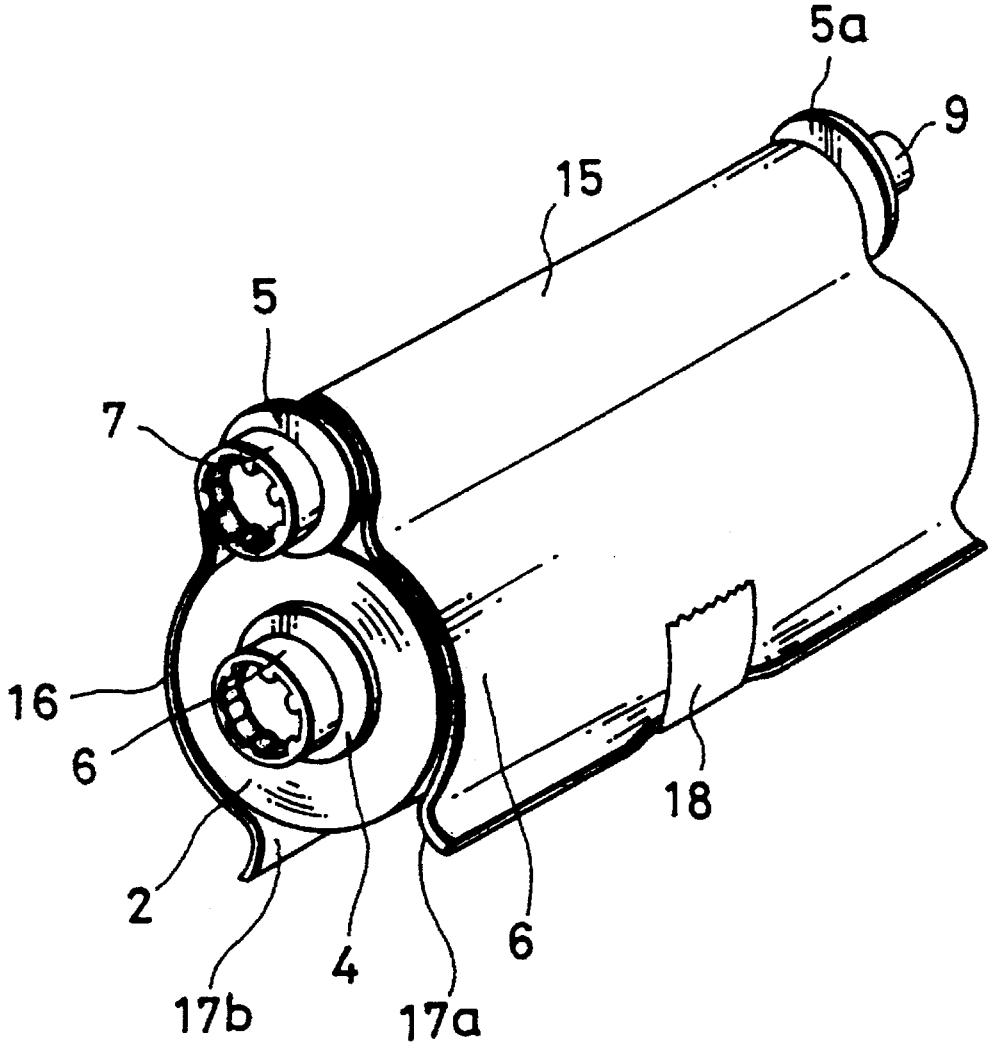
FIG. 7 is a perspective view showing the manner in which supply and take-up spools of the ink ribbon unit are fastened and locked against rotation by the holder according to the first embodiment.

The holder 14 can be installed on the ink ribbon unit 10 as follows: The holder 14 is placed over the ink ribbon unit 10 through its slot between the curled portions 17*a*, 17*b*. The holder 14 is continuously fitted over the ink ribbon unit 10 until the first holding portion 15 is placed around the take-up spool 3 and the second holding portions 16 are placed around the diametrically opposite surfaces of the ink ribbon 2 on the supply spool 1, as shown in FIG. 7. Thereafter, the curled portions 17*a*, 17*b* of the holder 14 are joined to each other by an adhesive tape 18 that is applied across an exposed surface of the ink ribbon 2 between the curled portions 17*a*, 17*b*. The supply and take-up spools 1, 3 are now fastened and locked against free rotation by the holder 14.

Figure 8:
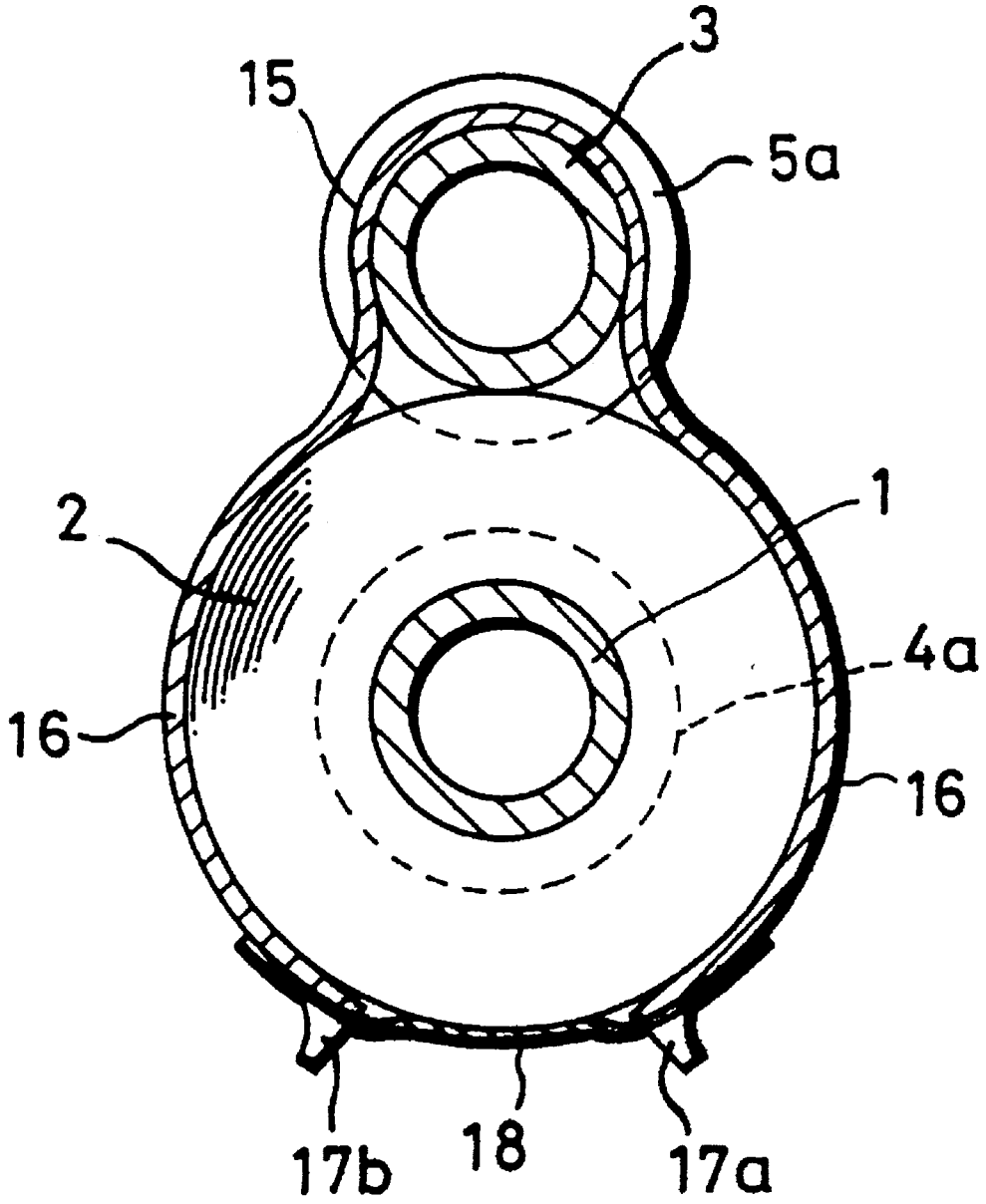
FIG. 8 is a cross-sectional view of the ink ribbon unit and the holder shown in FIG. 7.

The ink ribbon unit 10 is now fully accommodated in the holder 14 as shown in FIGS. 7 and 8. In FIGS. 7 and 8, the take-up spool 3 is held in intimate contact with and accommodated in the first holding portion 15, and the diametrically opposite surfaces of the ink ribbon 2 are held in intimate contact with and accommodated in the second holding portions 16. The first and second holding portions 15, 16 are therefore effective in reliably fastening and holding the supply and take-up spools 1, 3 against free rotation, and also preventing the ink ribbon 2 from being disturbed in its wound state. Furthermore, because the ink ribbon 2 is protected by the holder 14, the user of the ink ribbon unit 10 can carry the ink ribbon unit 10 without touching the ink ribbon 2. Therefore, the ink ribbon 2 is protected against damage or quality loss while it is being carried or in storage. The holder 14 as it accommodates the ink ribbon unit 10 has its opposite axial ends held in substantial contact with the flanges 4, 5 of the driving side shafts 6, 7 and the flanges 4*a*, 5*a* of the rotary side shafts 8, 9. Consequently, the supply and take-up spools 1, 3 are prevented from axially wobbling. The outwardly curled portions 17*a*, 17*b* of the holder 14 do not scratch or otherwise damage the surfaces of the ink ribbon 2 even though the outwardly curled portions 17*a*, 17*b* contact the ink ribbon 2 when the holder 14 is installed on the ink ribbon unit 10. The ink ribbon unit 10 thus accommodated in the holder 14 is packaged and offered for sale.

The adhesive tape 18 which interconnects the curled portions 17*a*, 17*b* of the holder 14 has an adhesive layer applied to the exposed surface of the ink ribbon 2 between the curled portions 17*a*, 17*b*. Because the adhesive tape 18 needs to be peeled off when the ink ribbon 2 is to be used, the adhesive of the adhesive tape 18 should preferably have a high degree of peelability such that no adhesive will remain on the ink ribbon 2 when the adhesive tape 18 is peeled off.

To use the ink ribbon unit 10, the adhesive tape 18 is peeled off, the holder 14 is removed from the ink ribbon unit 10.

In the second embodiment, the supply and take-up spools are held parallel to each other and the supply and take-up spools are surrounded by the sheet-like holder around the outer surface of the ink ribbon, with the free ends of the holder being secured by a joint means. Therefore, the supply and take-up spools are reliably fastened and locked against free rotation, and the ink ribbon on the supply and take-up spools is protected by the holder. The user can thus handle the ink ribbon unit without touching the same, so that the quality of the ink ribbon can be maintained.

Because the joint means which secures the free ends of the holder comprises an adhesive tape, the supply and take-up spools can efficiently and easily be fastened and locked against free rotation at a low cost.

The holder can easily be formed by vacuum forming, and the formed folder is prevented from collapsing out of shape.

Figure 9:
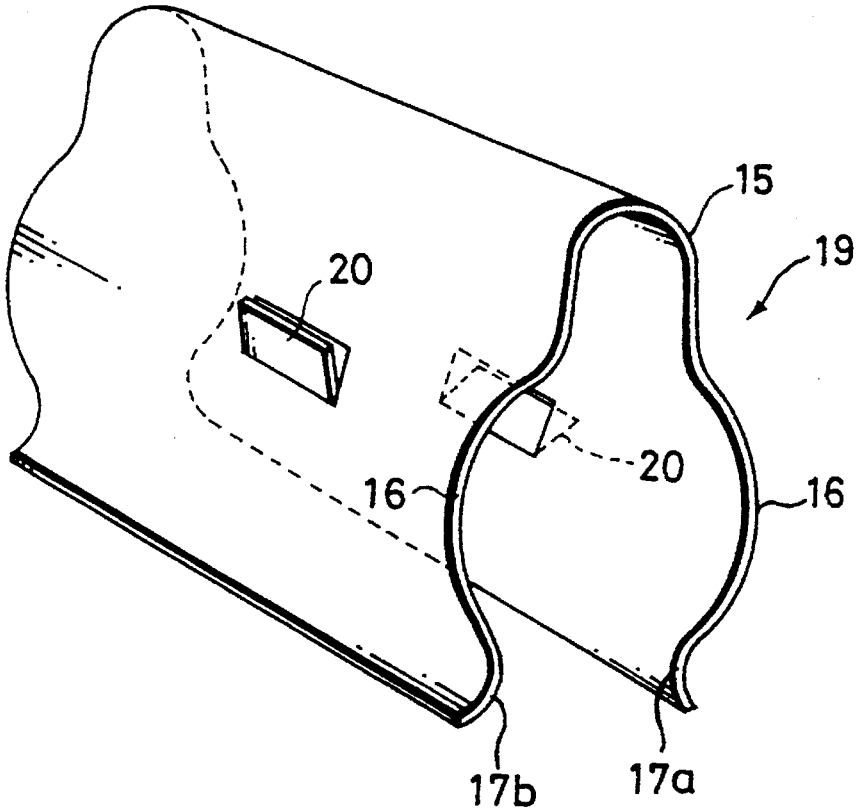
FIG. 9 is a perspective view of an ink ribbon unit and a holder according to a second embodiment of the present invention, the holder being shown as separate from the ink ribbon unit.
Figure 9:
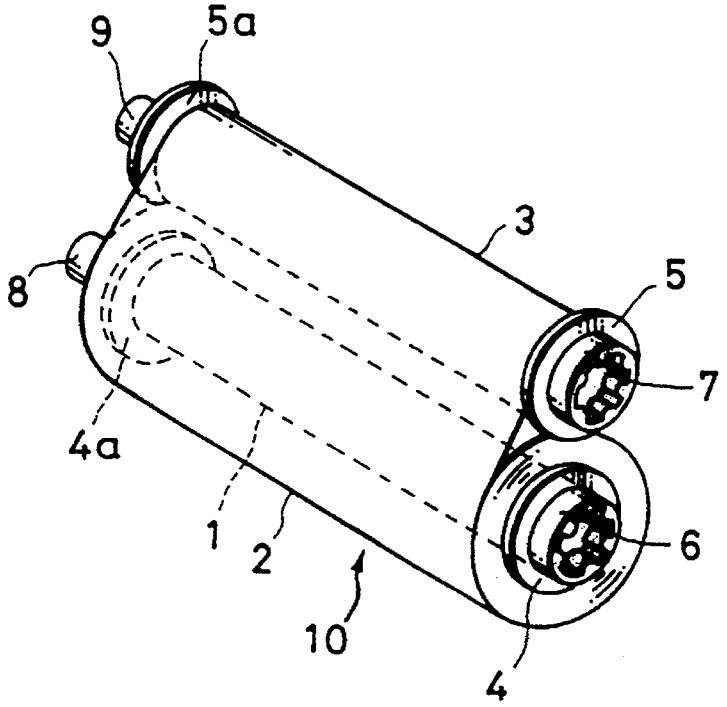

FIG. 9 shows an ink ribbon unit and a holder according to a second embodiment of the present invention, the holder being shown as separate from the ink ribbon unit.

The ink ribbon unit according to the second embodiment of the present invention is identical to the ink ribbon unit 10 according to the first embodiment shown in FIG. 6, and will not be described in detail below. The parts of the ink ribbon unit according to the second embodiment are denoted by identical reference numerals used to represent the same parts of the ink ribbon unit according to the first embodiment.

The ink ribbon unit 10 according to the second embodiment is combined with a holder 19 which is identical to the holder 14 according to the first embodiment in that it has a first holding portion 15, a pair of second holding portions 16, and a pair of curled portions 17*a*, 17*b*. According to the second embodiment, the holder 19 additionally has a pair of central hooks 20 raised outwardly out of the respective second holding portions 16.

Figure 10:
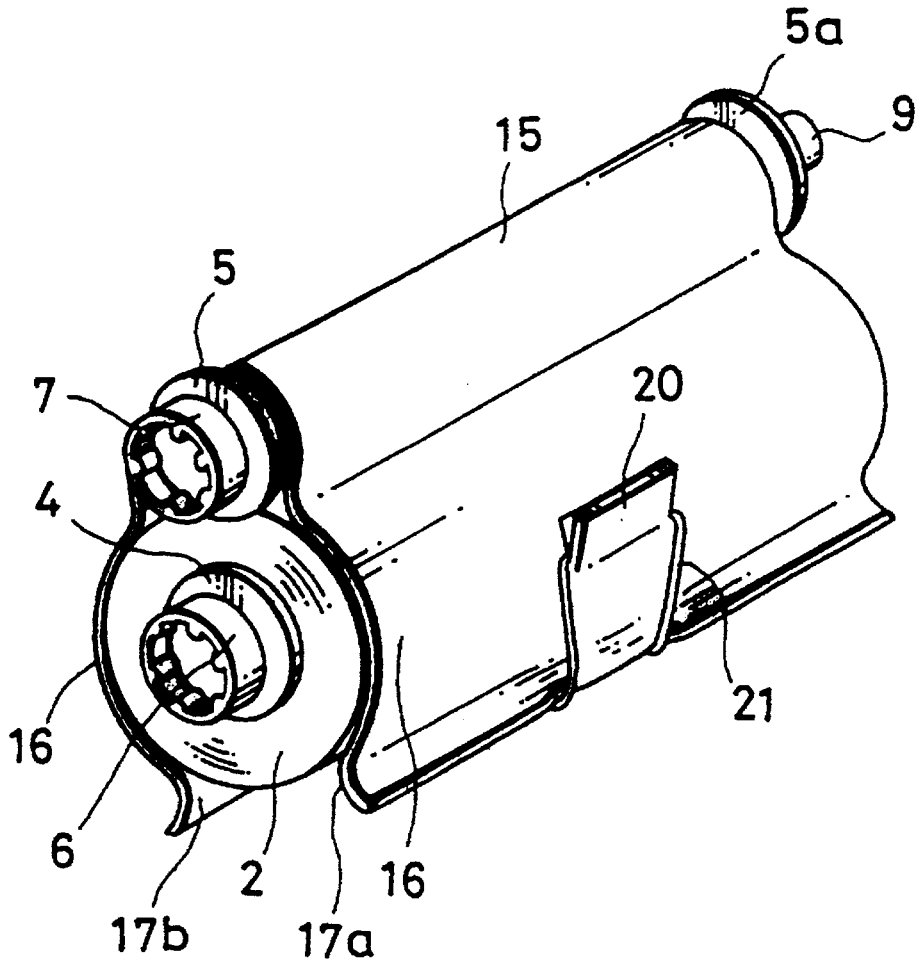
FIG. 10 is a perspective view showing the manner in which supply and take-up spools of the ink ribbon unit are fastened and locked against rotation by the holder according to the second embodiment.

The holder 19 can be installed on the ink ribbon unit 10 as follows: As with the first embodiment, the first holding portion 15 is placed around the take-up spool 3 and the second hplding portions 16 are placed around the diametrically opposite surfaces of the ink ribbon 2 on the supply spool 1, as shown in FIG. 10. Thereafter, a looped rubber member, i.e., a rubber band 21, is placed in engagement with the hooks 20 on the second holding portions 16 across the curled portions 17*a*, 17*b* and an exposed surface of the ink ribbon 2 between the curled portions 17*a*, 17*b*.

Figure 11:
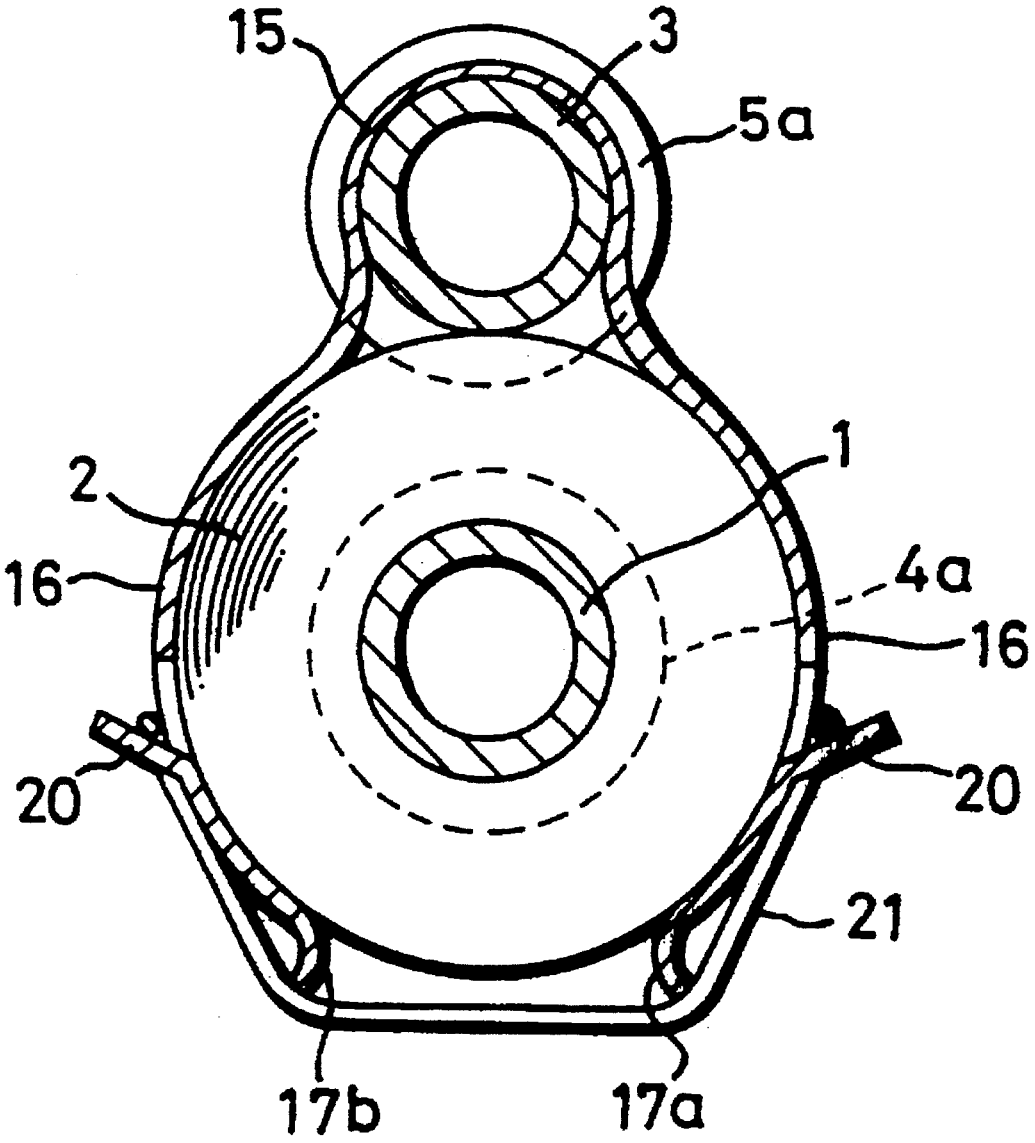
FIG. 11 is a cross-sectional view of the ink ribbon unit and the holder shown in FIG. 10.

The ink ribbon unit 10 is now fully accommodated in the holder 19 as shown in FIGS. 10 and 11. In FIGS. 10 and 11, the take-up spool 3 is held in intimate contact with and accommodated in the first holding portion 15, and the diametrically opposite surfaces of the ink ribbon 2 are held in intimate contact with and accommodated in the second holding portions 16. The first and second holding portions 15, 16 are therefore effective in reliably fastening and holding the supply and take-up spools 1, 3 against free rotation, and also preventing the ink ribbon 2 from being disturbed in its wound state. Furthermore, because the ink ribbon 2 is protected by the holder 19, the user of the ink ribbon unit 10 can carry the ink ribbon unit 10 without touching the ink ribbon 2. Therefore, the ink ribbon 2 is protected against damage or quality loss while it is being carried or in storage. The holder 19 as it accommodates the ink ribbon unit 10 has its opposite axial ends held in substantial contact with the flanges 4, 5 of the driving side shafts 6, 7 and the flanges 4*a*, 5*a* of the rotary side shafts 8, 9. Consequently, the supply and take-up spools 1, 3 are prevented from axially wobbling. The outwardly curled portions 17*a*, 17*b* of the holder 19 do not scratch or otherwise damage the surfaces of the ink ribbon 2 even though the outwardly curled portions 17*a*, 17*b* contact the ink ribbon 2 when the holder 19 is installed on the ink ribbon unit 10. The ink ribbon unit 10 thus accommodated in the holder 19 is packaged and offered for sale.

To use the ink ribbon unit 10, the rubber band 21 is detached from the hooks 20, and the holder 19 is removed from the ink ribbon unit 10.

In the second embodiment, the joint means which secures the free ends of the holder comprises a looped rubber member that can be elastically expanded and contracted which is engaged by the hooks. Therefore, the supply and take-up spools can efficiently and easily be fastened and locked against free rotation at a low cost, and the holder can be detached and attached with ease.

Figure 12:
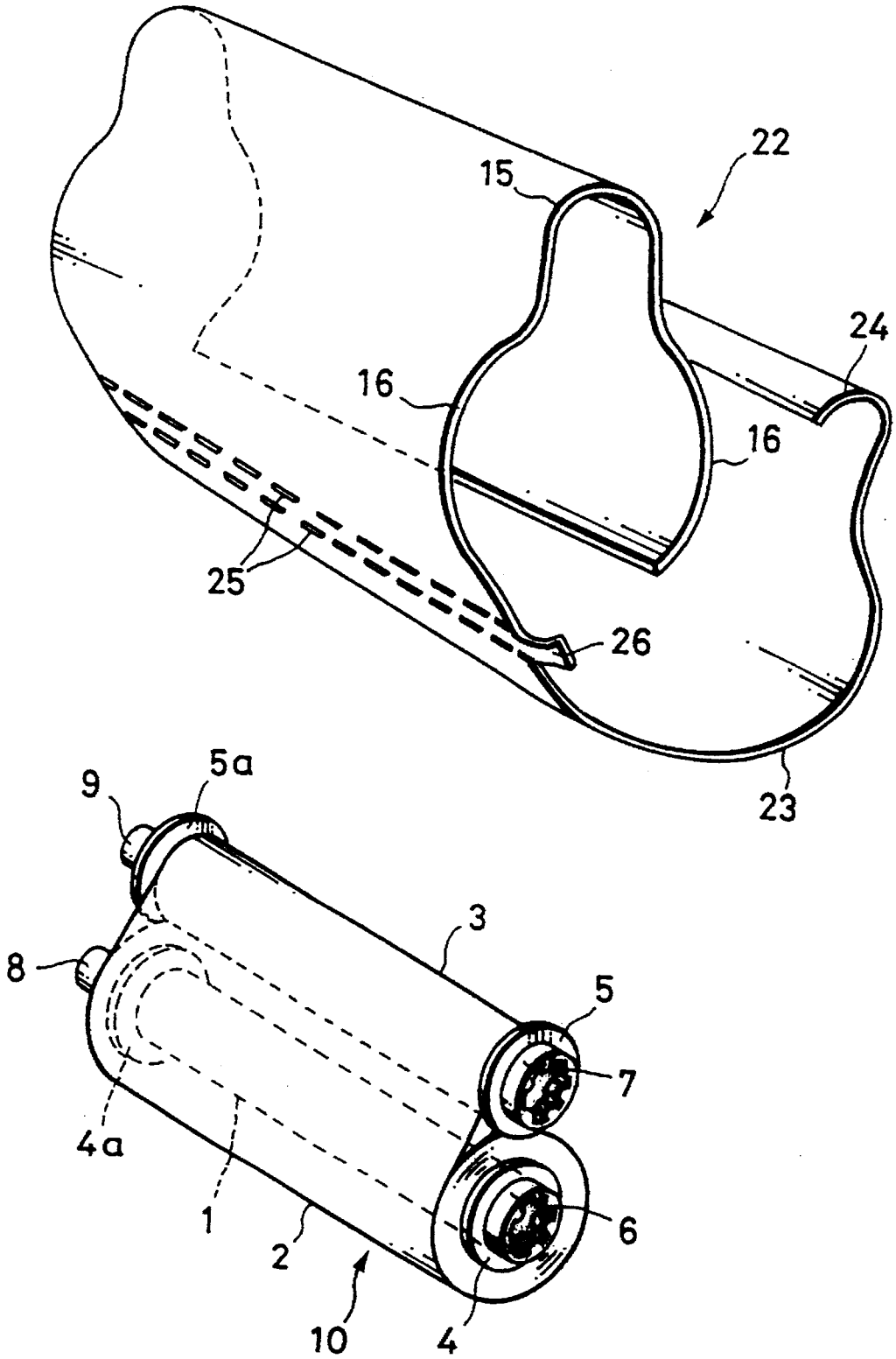
FIG. 12 is a perspective view of an ink ribbon unit and a holder according to a third embodiment of the present invention, the holder being shown as separate from the ink ribbon unit.

FIG. 12 shows an ink ribbon unit and a holder according to a third embodiment of the present invention, the holder being shown as separate from the ink ribbon unit.

The ink ribbon unit according to the third embodiment of the present invention is identical to the ink ribbon unit 10 according to the first embodiment shown in FIG. 6, and will not be described in detail below. The parts of the ink ribbon unit according to the third embodiment are denoted by identical reference numerals used to represent the same parts of the ink ribbon unit according to the first embodiment.

The ink ribbon unit 10 according to the second embodiment is combined with a holder 22 which is identical to the holder 14 according to the first embodiment in that it has a first holding portion 15 and a pair of second holding portions 16. According to the third embodiment, the holder 22 additionally has a curved extension 23 extending from one of the second holding portions 16, and a curled engaging portion 24 on a distal end of the curved extension 23. The holder 22 also has a cut-off region lying substantially between the second holding portion 16 and the extension 23 and extending transversely of the holder 22, the cut-off region being composed of two severance lines 25 comprising parallel series of perforations and a tab 26 joined to an end of the holder 22 between the severance lines 25.

Figure 13:
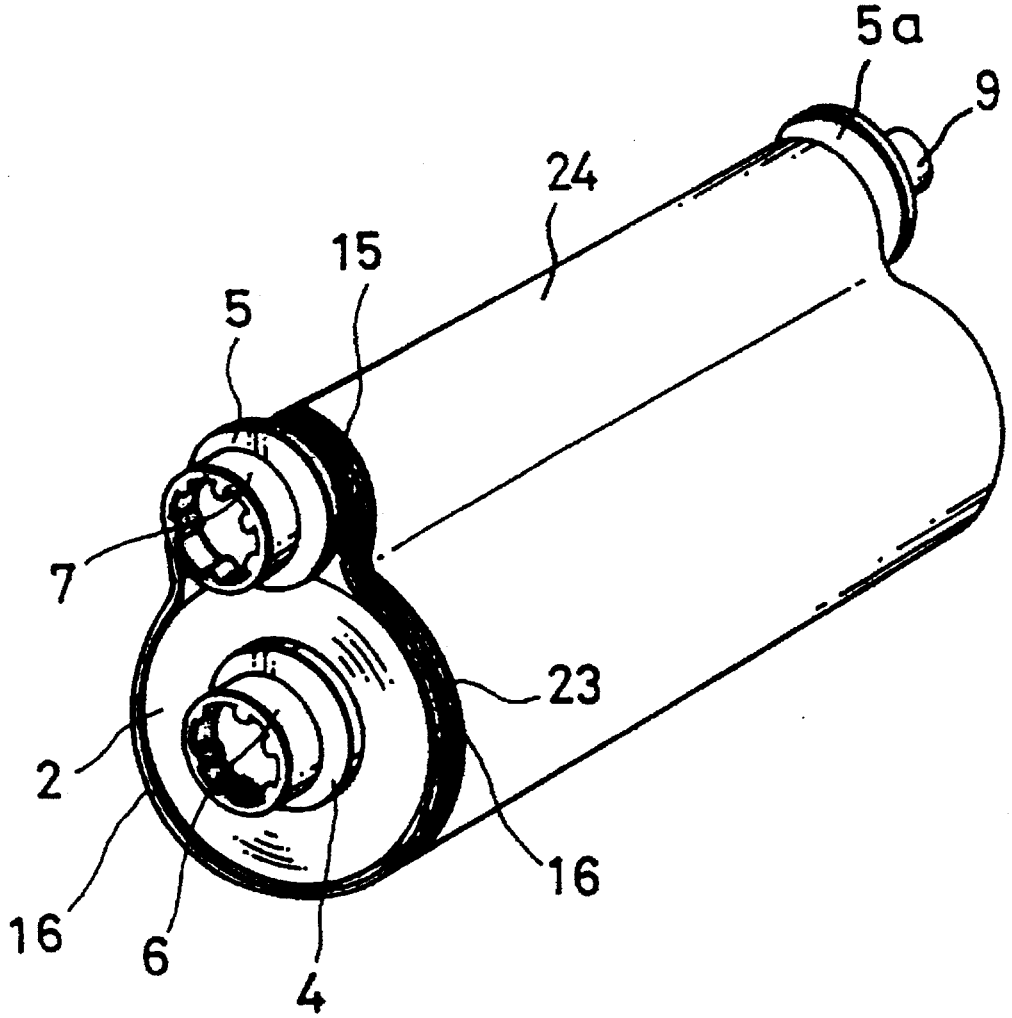
FIG. 13 is a perspective view showing the manner in which supply and take-up spools of the ink ribbon unit are fastened and locked against rotation by the holder according to the third embodiment.

The holder 22 can be installed on the ink ribbon unit 10 as follows: As with the first embodiment, the first holding portion 15 is placed around the take-up spool 3 and the second holding portions 16 are placed around the diametrically opposite surfaces of the ink ribbon 2 on the supply spool 1, as shown in FIG. 13. Thereafter, the extension 23 is superposed on the outer surface of the other second holding portion 16, and the engaging portion 24 is placed in engagement with the outer surface of the first holding portion 15.

Figure 14:
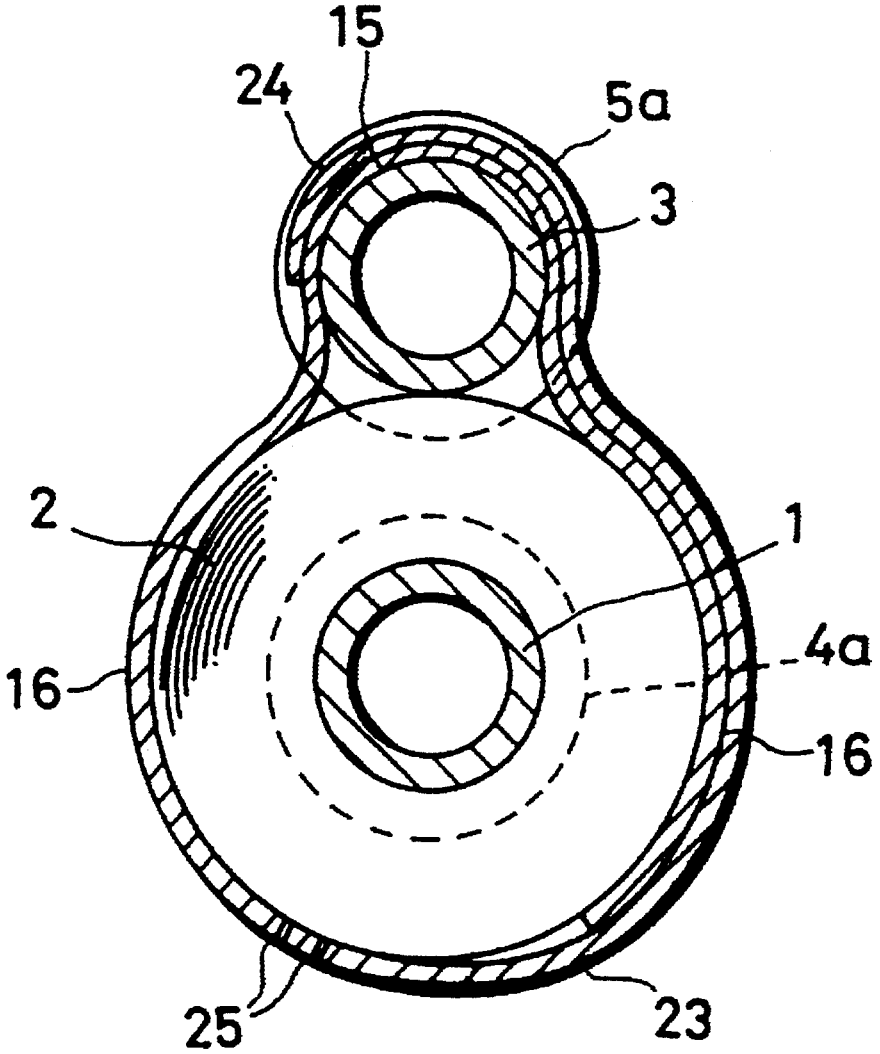
FIG. 14 is a cross-sectional view of the ink ribbon unit and the holder shown in FIG. 13.

The ink ribbon unit 10 is now fully accommodated in the holder 22 as shown in FIGS. 13 and 14. In FIGS. 13 and 14, the take-up spool 3 is held in intimate contact with and accommodated in the first holding portion 15, and the diametrically opposite surfaces of the ink ribbon 2 are held in intimate contact with and accommodated in the second holding portions 16. The first and second holding portions 15, 16 are therefore effective in reliably fastening and holding the supply and take-up spools 1, 3 against free rotation, and also preventing the ink ribbon 2 from being disturbed in its wound state. Furthermore, because the ink ribbon 2 is protected by the holder 14, the user of the ink ribbon unit 10 can carry the ink ribbon unit 10 without touching the ink ribbon 2. Therefore, the ink ribbon 2 is protected against damage or quality loss while it is being carried or in storage. The holder 22 as it accommodates the ink ribbon unit 10 has its opposite axial ends held in substantial contact with the flanges 4, 5 of the driving side shafts 6, 7 and the flanges 4*a*, 5*a* of the rotary side shafts 8, 9. Consequently, the supply and take-up spools 1, 3 are prevented from axially wobbling. The ink ribbon unit 10 thus accommodated in the holder 22 is packaged and offered for sale.

To use the ink ribbon unit 10, the tab 26 of the cut-off region is gripped, and pulled across the holder 22, severing the holder 22 along the severance lines 25. The ink ribbon unit 10 can now be removed from the holder 22.

Even if the holder 22 does not have the cut-off region composed of the severance lines 25 and the tab 26, the user can remove the ink ribbon unit 10 from the holder 22 by detaching the engaging portion 24 out of engagement with the outer surface of the first holding portion 15.

In the third embodiment, the joint means comprises the extension from one free end of the holder and the curled engaging member on its end for engaging the curved area of the holder. The supply and take-up spools can thus easily be fastened and locked against free rotation without need for any separate member.

Since the holder has the cut-off region including the severance lines that extend across the holder, the holder can easily be cut off, allowing the ink ribbon unit to be removed with ease.

Figure 15:
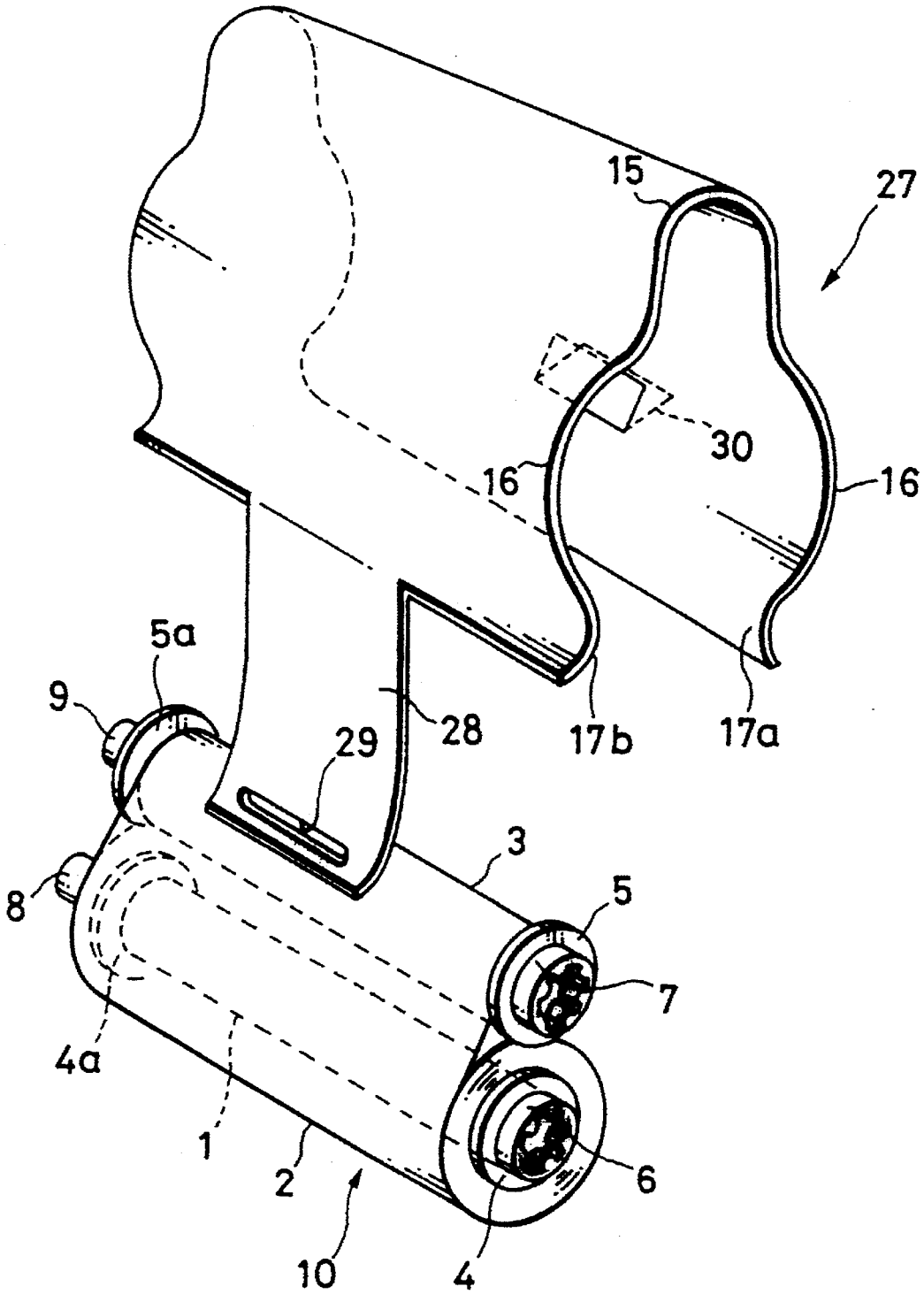
FIG. 15 is a perspective view of an ink ribbon unit and a holder according to a fourth embodiment of the present invention, the holder being shown as separate from the ink ribbon unit.

FIG. 15 shows an ink ribbon unit and a holder according to a fourth embodiment of the present invention, the holder being shown as separate from the ink ribbon unit.

The ink ribbon unit according to the fourth embodiment of the present invention is identical to the ink ribbon unit 10 according to the first embodiment shown in FIG. 6, and will not be described in detail below. The parts of the ink ribbon unit according to the fourth embodiment are denoted by identical reference numerals used to represent the same parts of the ink ribbon unit according to the first embodiment.

The ink ribbon unit 10 according to the fourth embodiment is combined with a holder 27 which is identical to the holder 14 according to the first embodiment in that it has a first holding portion 15, a pair of second holding portions 16, and a pair of curled portions 17*a*, 17*b*. According to the fourth embodiment, the holder 27 additionally has a central web 28 integral with and extending from the curled portion 17*b*, and the web 28 has an elongate engaging hole 29 defined in a distal end thereof and extending parallel to the curled portion 17*b*. The holder 27 also has a central hook 30 raised outwardly out of the second holding portion 16 near the curled portion 17*a*.

Figure 16:
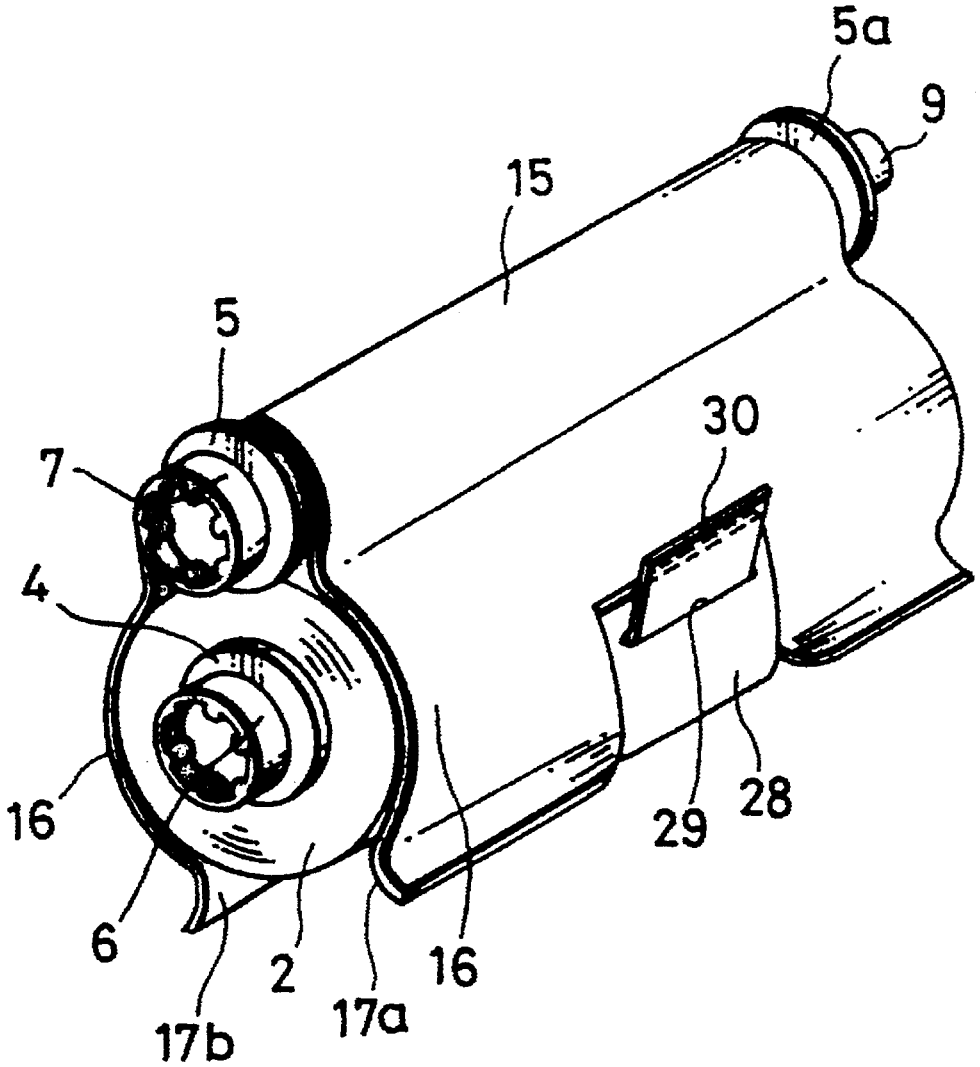
FIG. 16 is a perspective view showing the manner in which supply and take-up spools of the ink ribbon unit are fastened and locked against rotation by the holder according to the fourth embodiment.

The holder 27 can be installed on the ink ribbon unit 10 as follows: As with the first embodiment, the first holding portion 15 is placed around the take-up spool 3 and the second holding portions 16 are placed around the diametrically opposite surfaces of the ink ribbon 2 on the supply spool 1, as shown in FIG. 16. Thereafter, the web 28 is placed, with an exposed surface of the ink ribbon 2 between the curled portions 17*a*, 17*b*, onto the curled portion 17*a*, and the engaging hole 29 is fitted over the hook 30.

Figure 17:
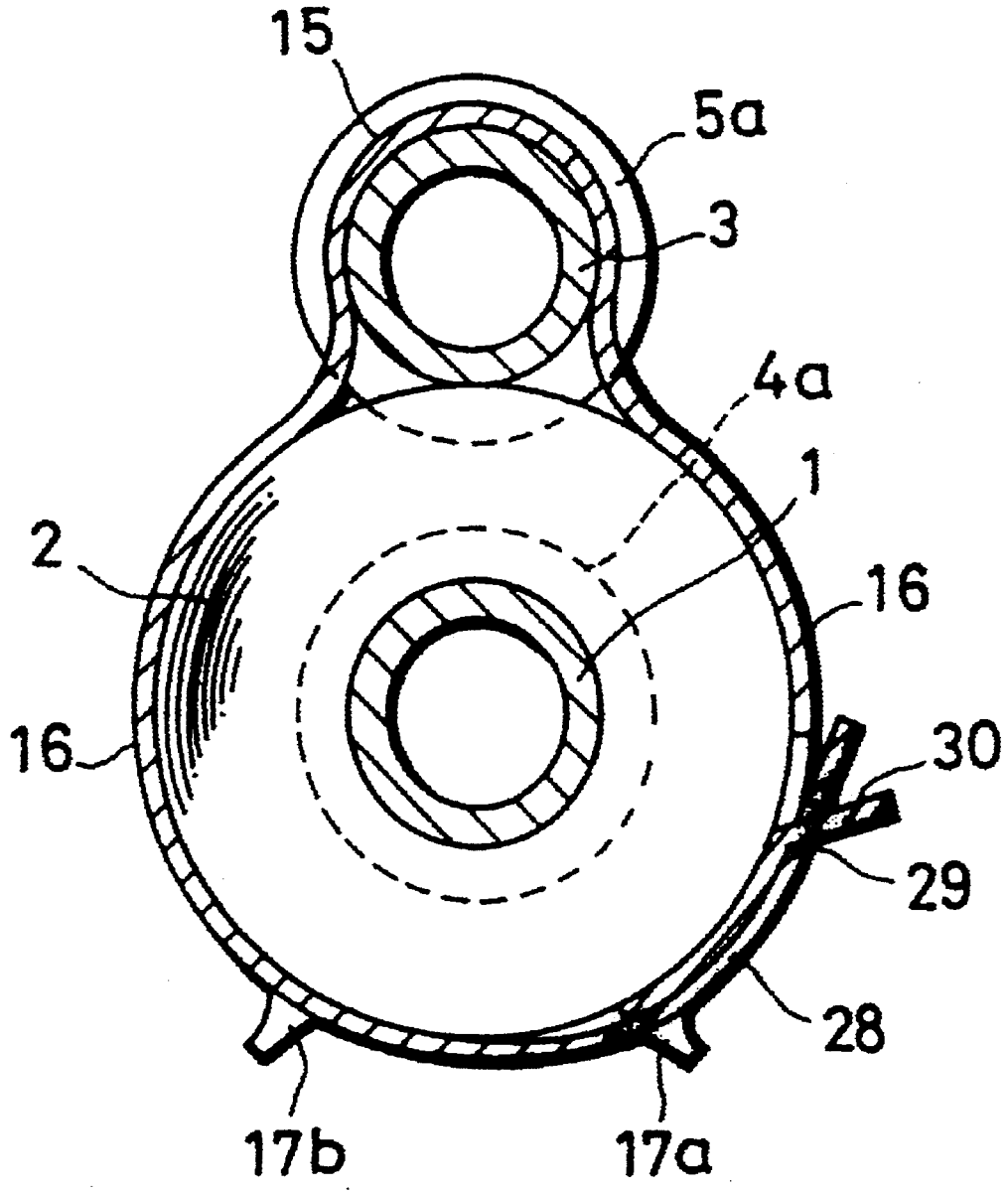
FIG. 17 is a cross-sectional view of the ink ribbon unit and the holder shown in FIG. 16.

The ink ribbon unit 10 is now fully accommodated in the holder 27 as shown in FIGS. 16 and 17. In FIGS. 16 and 17, the take-up spool 3 is held in intimate contact with and accommodated in the first holding portion 15, and the diametrically opposite surfaces of the ink ribbon 2 are held in intimate contact with and accommodated in the second holding portions 16. The first and second holding portions 15, 16 are therefore effective in reliably fastening and holding the supply and take-up spools 1, 3 against free rotation, and also preventing the ink ribbon 2 from being disturbed in its wound state. Furthermore, because the ink ribbon 2 is protected by the holder 27, the user of the ink ribbon unit 10 can carry the ink ribbon unit 10 without touching the ink ribbon 2. Therefore, the ink ribbon 2 is protected against damage or quality loss while it is being carried or in storage. The holder 27 as it accommodates the ink ribbon unit 10 has its opposite axial ends held in substantial contact with the flanges 4, 5 of the driving side shafts 6, 7 and the flanges 4*a*, 5*a* of the rotary side shafts 8, 9. Consequently, the supply and take-up spools 1, 3 are prevented from axially wobbling. The outwardly curled portions 17*a*, 17*b* of the holder 27 do not scratch or otherwise damage the surfaces of the ink ribbon 2 even though the outwardly curled portions 17*a*, 17*b* contact the ink ribbon 2 when the holder 27 is installed on the ink ribbon unit 10. The ink ribbon unit 10 thus accommodated in the holder 27 is packaged and offered for sale.

To use the ink ribbon unit 10, the web 28 is disengaged from the hook 30, and the holder 27 is removed from the ink ribbon unit 10.

In the holders according to the first through fourth embodiments, the first holding portion 15 and the second holding portions 16 are of fixed shapes and have a certain degree of elasticity. In the process of installing these holders on the respective ink ribbon units 10, the holders are first spread when they accommodate the supply and take-up spools 1, 3 and then automatically restore their original shape from the spread condition under their own resiliency. Accordingly, the holders can easily be mounted on the respective ink ribbon units 10.

In the fourth embodiment, the joint means comprises the web integral with and extending from one free end of the holder, and the hook raised from the holder near the other free end thereof for being fitted into the engaging hole defined in the web. Consequently, the supply and take-up spools can efficiently and reliably be fastened and locked against free rotation without need for any separate member.

Figure 18:
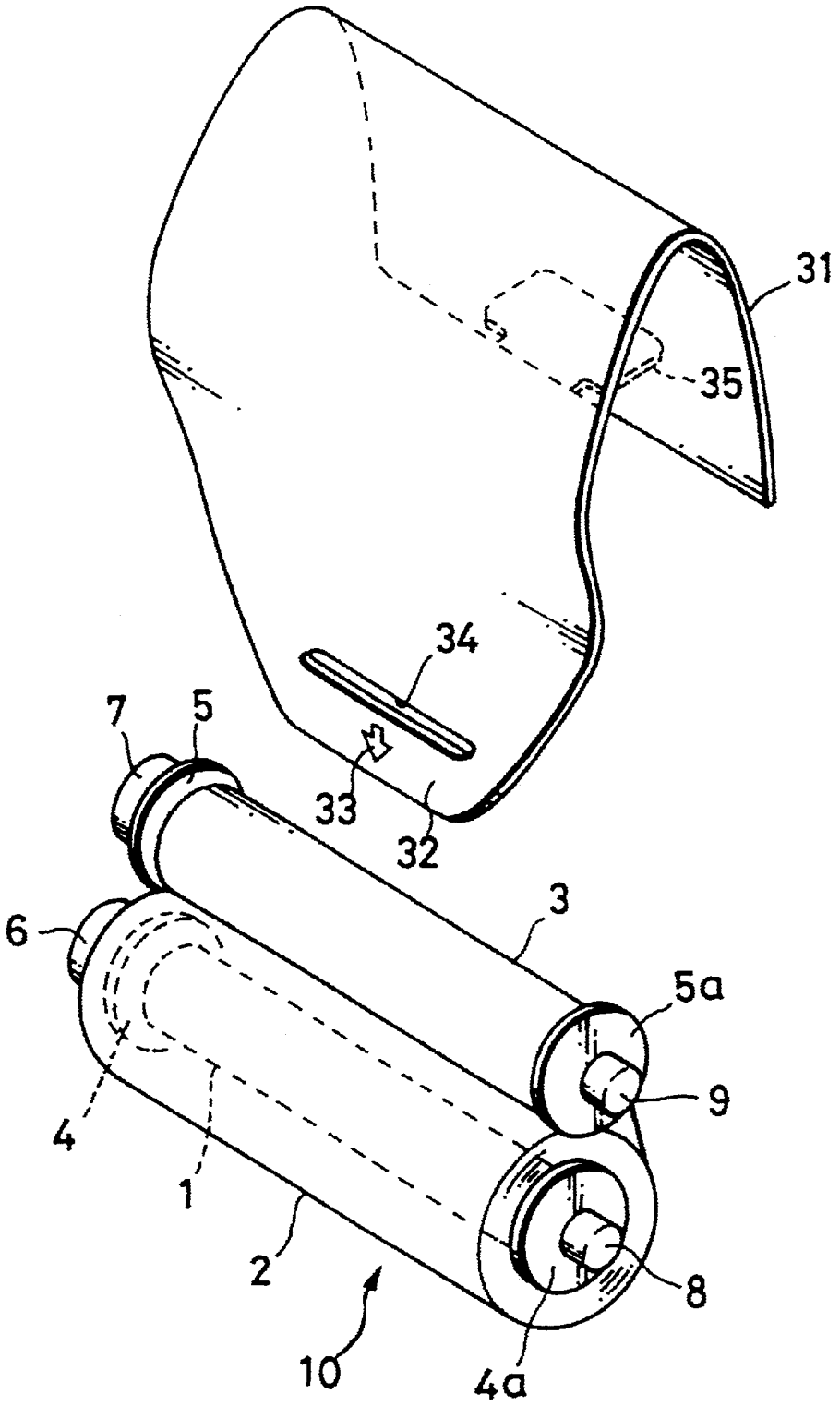
FIG. 18 is a perspective view of an ink ribbon unit and a holder according to a fifth embodiment of the present invention, the holder being shown as separate from the ink ribbon unit.

FIG. 18 shows an ink ribbon unit and a holder according to a fifth embodiment of the present invention, the holder being shown as separate from the ink ribbon unit.

The ink ribbon unit according to the fifth embodiment of the present invention is identical to the ink ribbon unit 10 according to the first embodiment shown in FIG. 6, and will not be described in detail below. The parts of the ink ribbon unit according to the fifth embodiment are denoted by identical reference numerals used to represent the same parts of the ink ribbon unit according to the first embodiment. In FIG. 18, the ink ribbon unit 10 is viewed from the side of the rotary side shafts 8, 9.

The ink ribbon unit 10 according to the fifth embodiment is combined with a holder 31. The holder 31 comprises a sheet of a plastic material such as PET (polyethylene terephthalate) or the like. The holder 31 has a certain degree of elasticity and rigidity, but does not have a fixed shape unlike the holders according to the first through fourth embodiments. The holder 31 includes an end tapered into a tab 32 that is marked with an arrow 33 and has an elongate engaging hole 34 defined in the tab 32 parallel to the end of the tab 32. The holder 31 also has a hook 35 bent back from an opposite end thereof.

The holder 31 is placed over the take-up spool 3 such that the tab 32 and the hook 35 are positioned on respective opposite sides of the ink ribbon unit 10. Thereafter, a portion of the holder 31 which extends toward the tab 32 is wound around an outer surface of the ink ribbon 2 on the supply spool 1. Then, the engaging hole 34 is fitted over the hook 35 that is positioned on the outer surface of the ink ribbon 2 as shown in FIG. 19.

Figure 19:
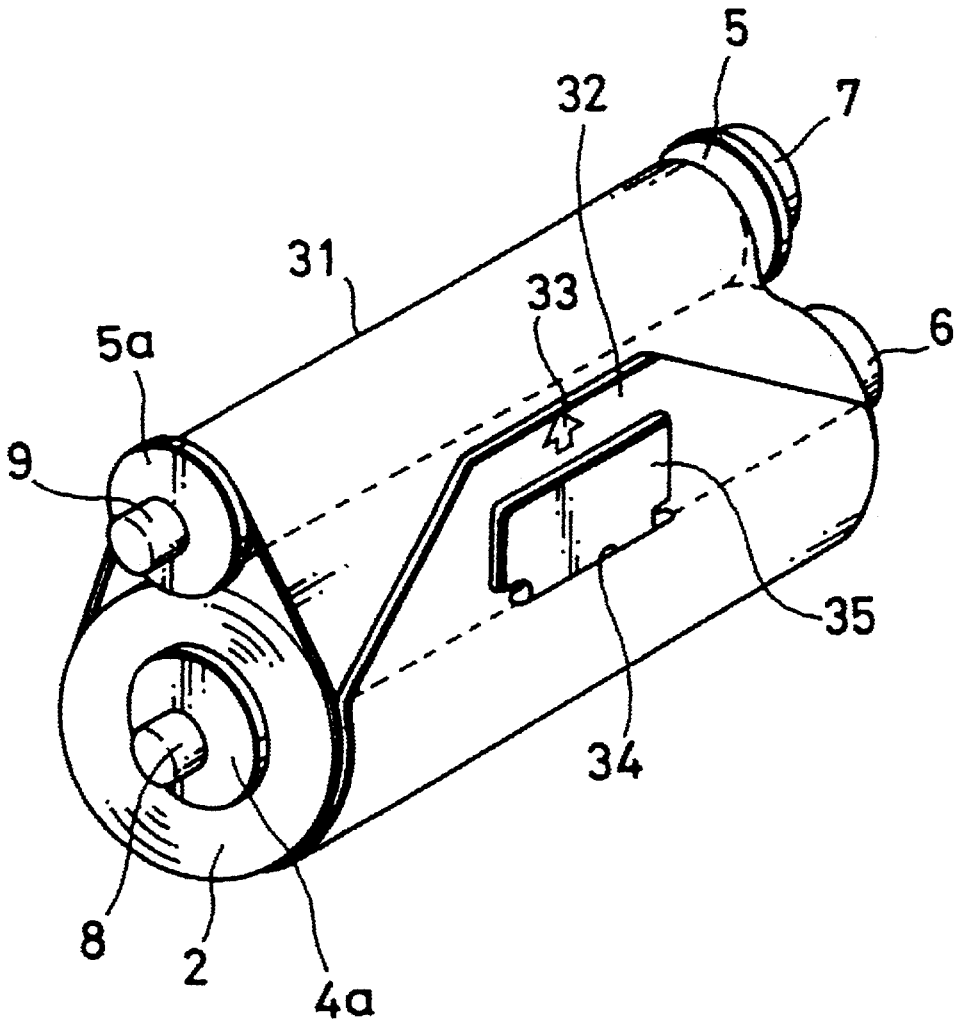
FIG. 19 is a perspective view showing the manner in which supply and take-up spools of the ink ribbon unit are fastened and locked against rotation by the holder according to the fifth embodiment.
Figure 20:
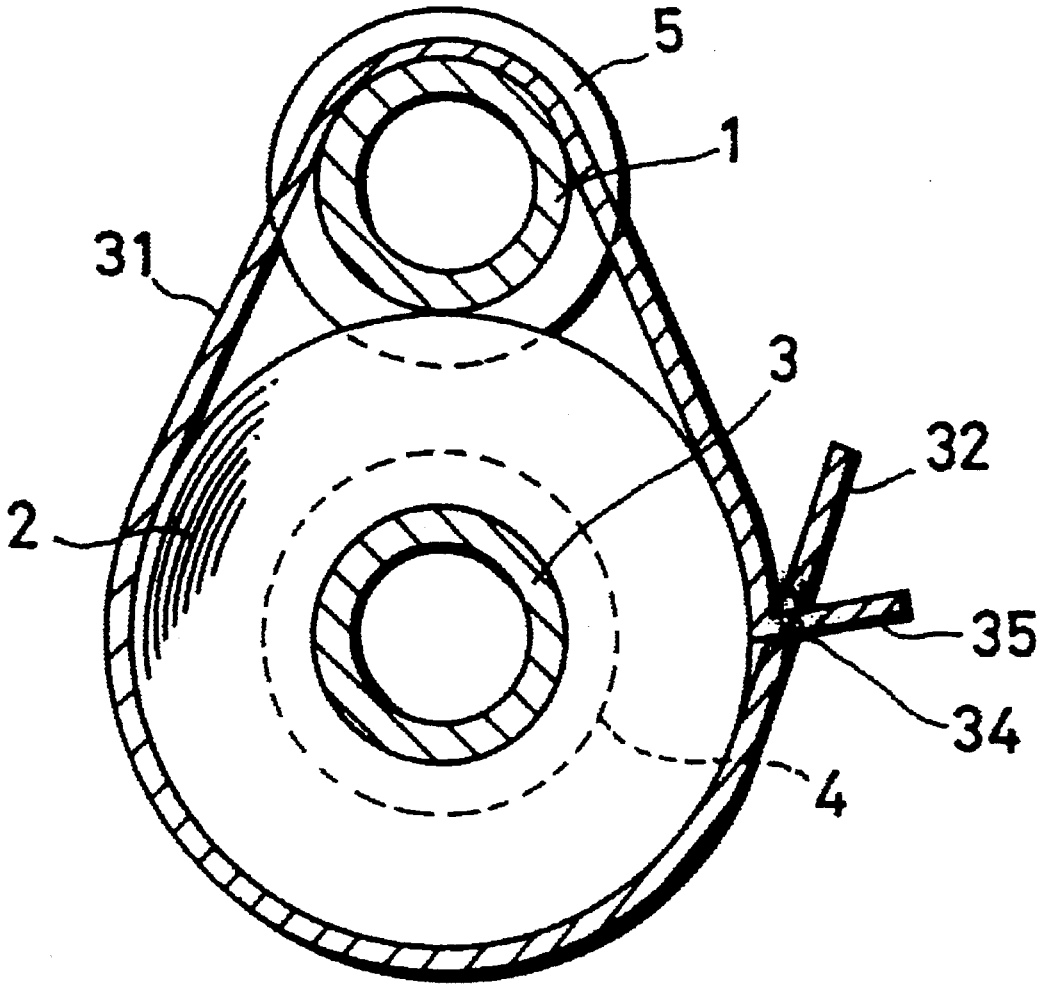
FIG. 20 is a cross-sectional view of the ink ribbon unit and the holder shown in FIG. 19.

The ink ribbon unit 10 is now fully accommodated in the holder 31 as shown in FIGS. 19 and 20. In FIGS. 19 and 20, the take-up spool 3 and the outer surface of the ink ribbon 2 on the supply spool 1 are held in intimate contact with and accommodated in the holder 31. The holder 31 is therefore effective in reliably fastening and holding the supply and take-up spools 1, 3 against free rotation, and also preventing the ink ribbon 2 from being disturbed in its wound state.

Furthermore, because the ink ribbon 2 is protected by the holder 31, the user of the ink ribbon unit 10 can carry the ink ribbon unit 10 without touching the ink ribbon 2. Therefore, the ink ribbon 2 is protected against damage or quality loss while it is being carried or in storage. The holder 31 as it accommodates the ink ribbon unit 10 has its opposite axial ends held in substantial contact with the flanges 4, 5 of the driving side shafts 6, 7 and the flanges 4*a*, 5*a* of the rotary side shafts 8, 9. Consequently, the supply and take-up spools 1, 3 are prevented from axially wobbling. The ink ribbon unit 10 thus accommodated in the holder 31 is packaged and offered for sale.

A procedure for the user to place the ink ribbon unit 10 that has been fastened and locked against free rotation by the holder 31 into an ink ribbon cartridge without touching the ink ribbon 2 will be described below with reference to FIGS. 21 through 24.

The ink ribbon cartridge comprises a somewhat tray-shaped cartridge casing 41 having on one end thereof a pair of transversely spaced driving side shaft bearings 42, 43 with respective circular bearing holes 42a, 43a defined therein. A recess 44 is defined in an upper edge of the driving side shaft bearing 42. The cartridge casing 41 also has on its other end a pair of transversely spaced rotary side shaft bearings 45, 46 with respective U-shaped bearing slots 45*a*, 46*a* defined therein. An opening 47 for positional alignment with a print head (not shown) is defined in the cartridge casing 41.

Figure 21:
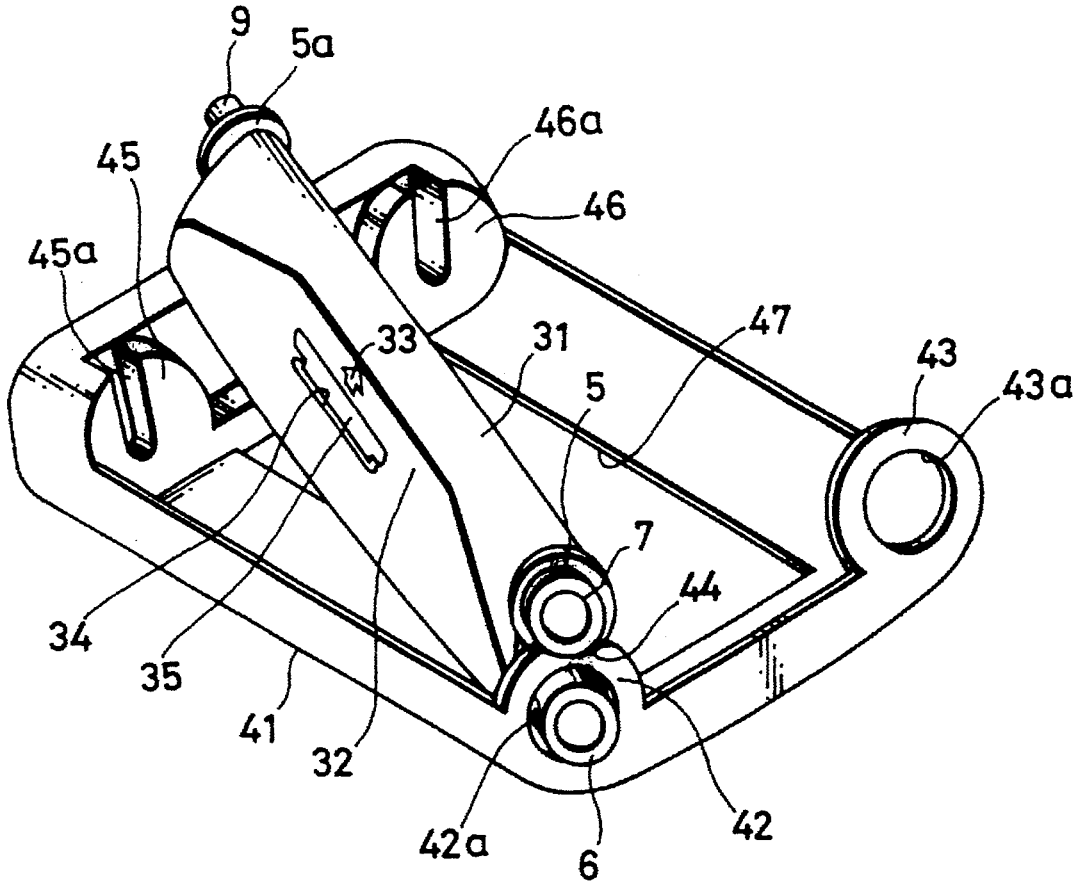
FIG. 21 is a perspective view showing the manner in which the ink ribbon unit according to the fifth embodiment is placed into an ink ribbon cartridge.
Figure 22:
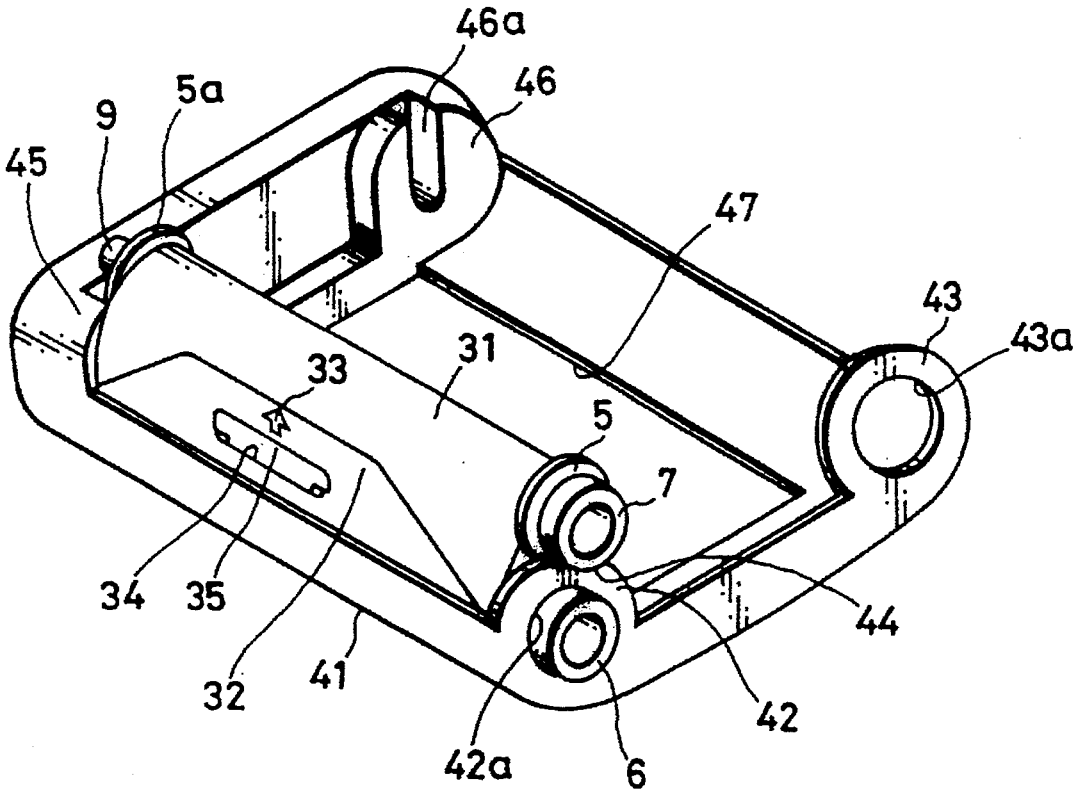
FIG. 22 is a perspective view showing the manner in which the ink ribbon unit according to the fifth embodiment is placed into the ink ribbon cartridge.

The ink ribbon unit 10 that has been fastened and locked against free rotation by the holder 31 can be placed into the ink ribbon cartridge of the above structure as follows: First, as shown in FIG. 21, the driving side shaft 6 of the supply spool 1 is inserted into the bearing hole 42*a* in the driving side shaft bearing 42, with the driving side shaft 7 of the take-up spool 3 being put in the recess 44 in the driving side shaft bearing 42. Thereafter, the rotary side shaft 9 of the supply spool 1 is inserted into the bearing slot 45*a* in the rotary side shaft bearing 45, as shown in FIG. 22.

Figure 23:
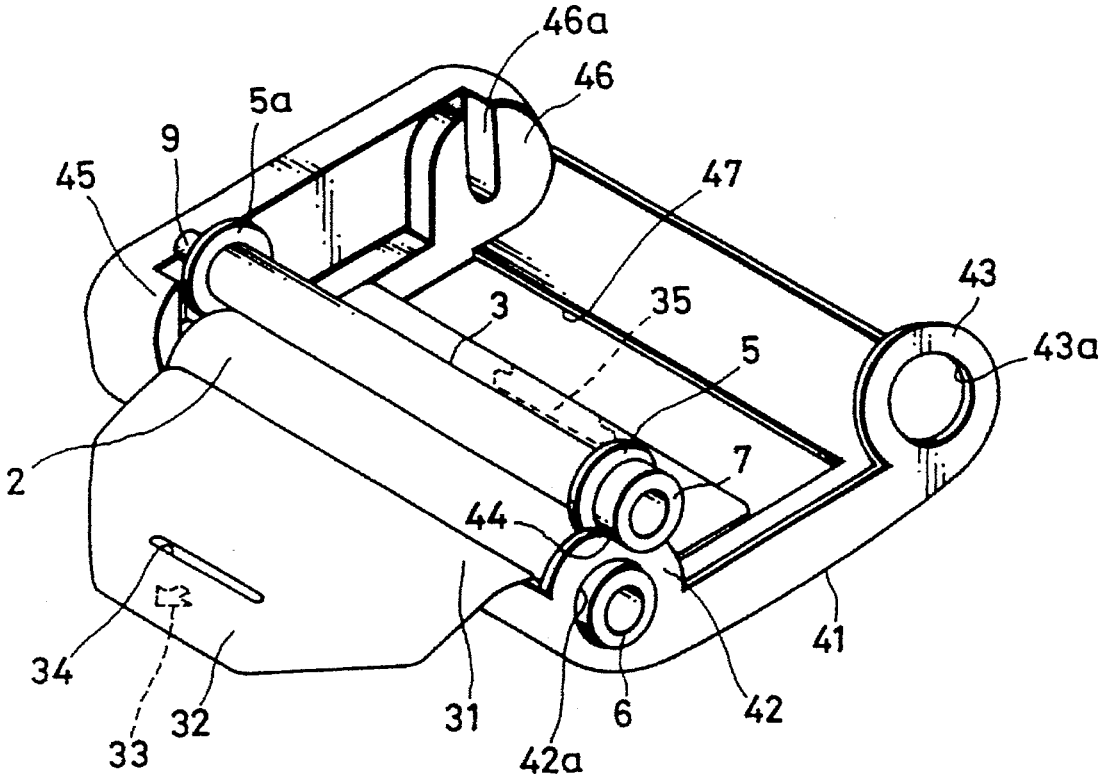
FIG. 23 is a perspective view showing the manner in which the ink ribbon unit according to the fifth embodiment is placed into the ink ribbon cartridge.
Figure 24:
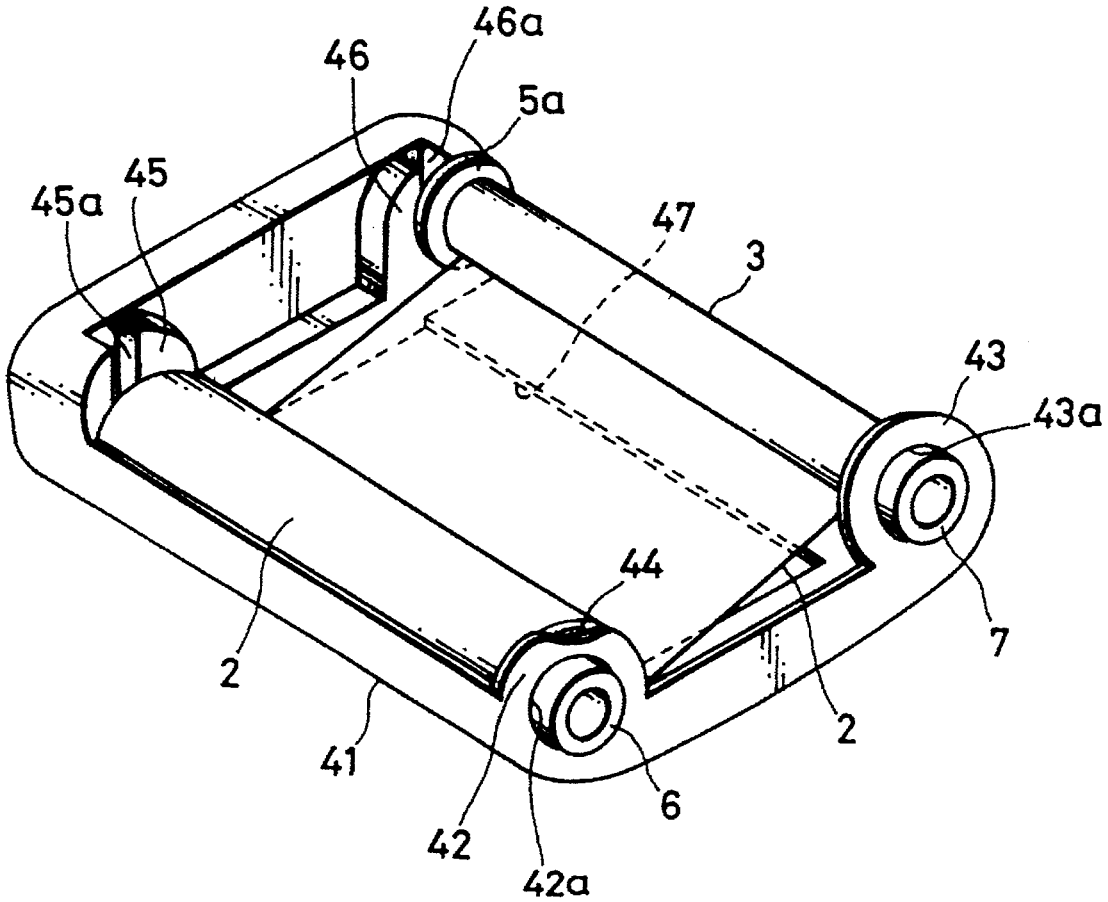
FIG. 24 is a perspective view showing the manner in which the ink ribbon unit according to the fifth embodiment is placed into the ink ribbon cartridge.

Then, the tab 32 of the holder 31 is gripped and disengaged from the hook 35. The tab 32 is pulled in the direction indicated by the arrow 33, as shown in FIG. 23, until the holder 31 is removed from the ink ribbon unit 10. Finally, as shown in FIG. 24, the take-up spool 3 is moved away from the supply spool 1, and the driving side shaft 7 of the take-up spool 3 is inserted into the bearing hole 43*a* in the driving side shaft bearing 43, and the rotary side shaft 9 of the take-up spool 3 is inserted into the bearing slot 46*a* in the rotary side shaft bearing 46. The ink ribbon unit 10 is now fully accommodated in the ink ribbon cartridge, as shown in FIG. 24. Accordingly, the user can place the ink ribbon unit 10 into the ink ribbon cartridge without touching the ink ribbon 2.

The ink ribbon unit 10 is accommodated in an ink ribbon cartridge whose size matches the size of a print area of the ink ribbon 2, e.g., the size of a print sheet such as a size A5 or a size A6, or the diameter of an ink ribbon roll such as a print area size 50 or a print area size 100. The ink ribbon cartridge is of a predetermined structure such that the supply spool 1 of the ink ribbon 10 is supported by the driving side and rotary side shaft bearings 42, 45 and the take-up spool 3 thereof is supported by the driving side and rotary side shaft bearings 43, 46.

Figure 25:
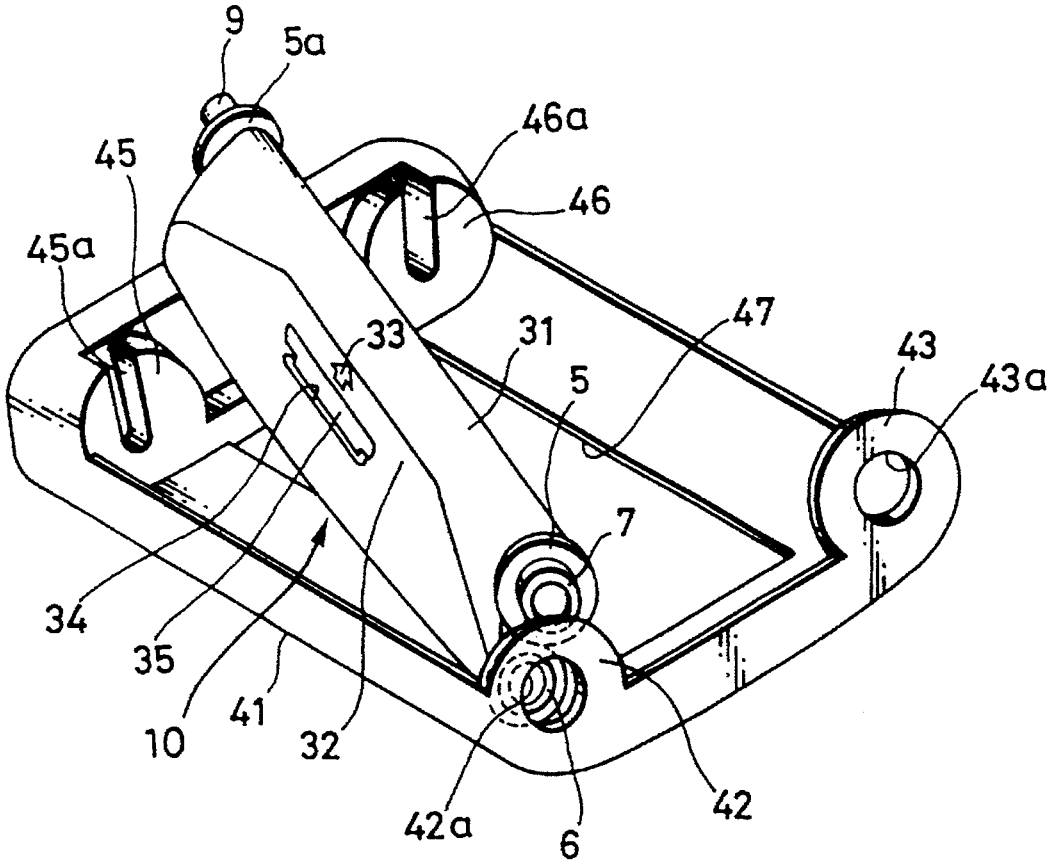
FIG. 25 is a perspective view illustrative of a problem imposed when the ink ribbon unit according to the present invention is placed into an ink ribbon cartridge.
Figure 26:
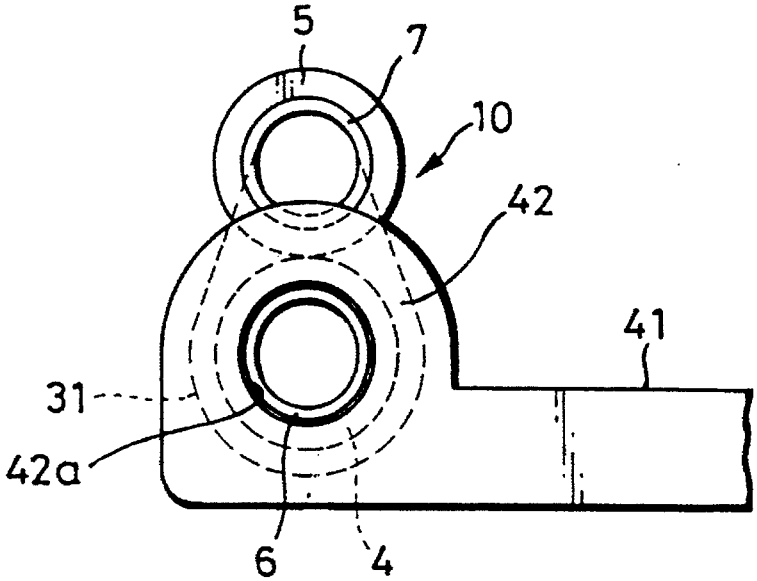
FIG. 26 is a fragmentary front elevational view of the ink ribbon cartridge loaded with the ink ribbon unit shown in FIG. 25.

More specifically, the ink ribbon unit 10 that has been fastened by the holder 31 has a predetermined interaxial distance between the driving side shafts 6, 7 of the supply and take-up spools 1, 3. Even if the user simply attempts to insert the driving side shaft 6 of the supply spool 1 into the bearing hole 42*a* in the driving side shaft bearing 42, the driving side shaft 6 cannot be inserted into the bearing hole 42*a* because of physical interference between the driving side shaft 7 of the take-up spool 3 and the driving side shaft bearing 42, as shown in FIGS. 25 and 26.

According to the present invention, as described above with respect to the fifth embodiment, the driving side shaft 7 of the take-up spool 3 is put in the recess 44 in the driving side shaft bearing 42 at the time the driving side shaft 6 of the supply spool 1 is inserted into the bearing hole 42*a* in the driving side shaft bearing 42. Since the driving side shaft 7 is received in the recess 44, the driving side shaft 6 can easily be inserted into the bearing hole 42*a*.

Figure 27:
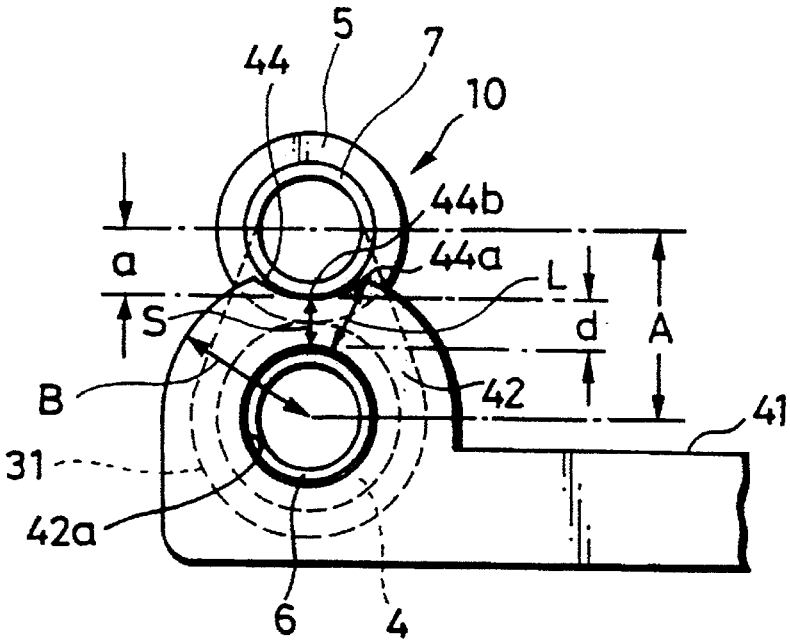
FIG. 27 is a fragmentary front elevational view of an ink ribbon cartridge loaded with the ink ribbon unit according to the present invention.

The ink ribbon cassette 10 fastened by the holder 31 and the driving side shaft bearing 42 of the cartridge casing 41 are dimensioned as follows:

As shown in FIG. 27, the supply and take-up spools 1, 3 of the ink ribbon cassette 10 fastened by the holder 31 have the respective flanges 4, 5 held against each other, and the driving side shafts 6, 7 thereof have the same diameter. If it is assumed that the central axes of the driving side shafts 6, 7 are spaced from each other by a distance "A", the driving side shafts 6, 7 have a radius "a", and the driving side shaft bearing 42 has a radius "B" from the center of the bearing hole 42*a* to its edge of a flange of the bearing 42, then these dimensions are selected to satisfy the following relationship:

$$(A-a)<B.$$

The recess 44 is of an arcuate shape and defined in an upper portion of the flange of the driving side shaft bearing 42. The radius of curvature of the arcuate recess 44 is greater than the radius of the driving side shaft 6 or the radius of the driving side shaft 7. The recess 44 is composed of a portion 44a that is spaced from the inner edge of the bearing hole 42*a* to the outer edge of the flange of bearing 42 with a distance "L"0 which is greater than the distance "d" between the outer circumferential surfaces of the driving side shafts 6, 7, and a portion 44*b* that is spaced from the inner edge of the bearing hole 42*a* to the outer edge of the flange of bearing 42 with a distance "S" which is greater than the distance "d".

If the user attempts to insert the driving side shaft 6 of the supply spool 1 into the bearing hole 42*a* in the driving side shaft bearing 42 with the driving side shaft 7 positioned out of the recess 44, then the driving side shaft 7 overlaps and interferes with the driving side shaft bearing 42 because of the dimensional relationship: (A–a)<B, and hence the driving side shaft 6 cannot be inserted into the bearing hole 42*a*. However, when the user attempts to insert the driving side shaft 6 of the supply spool 1 into the bearing hole 42*a* in the driving side shaft bearing 42 with the driving side shaft 7 positioned in the recess 44, then since the driving side shaft 7 does not overlap and interfere with the driving side shaft bearing 42, the driving side shaft 6 is aligned with and hence can be inserted into the bearing hole 42*a*.

Figure 28:
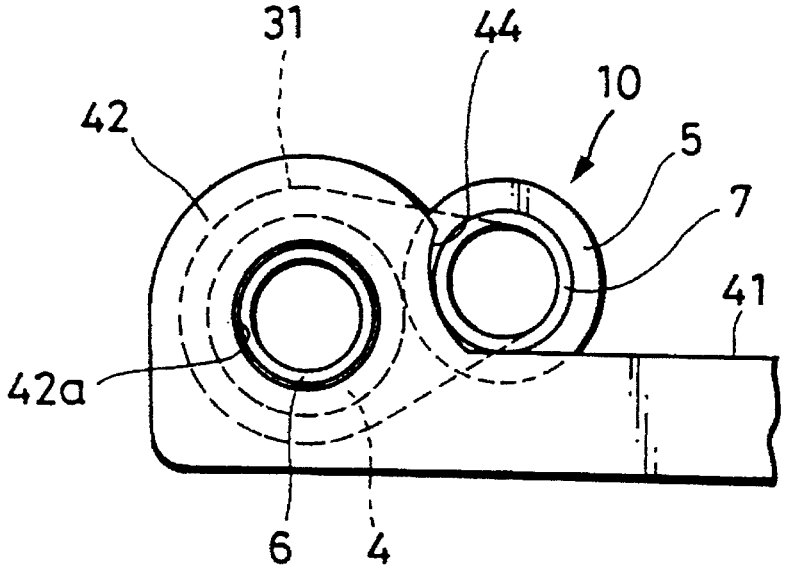
FIG. 28 is a fragmentary front elevational view of another ink ribbon cartridge loaded with the ink ribbon unit according to the present invention.

In the above embodiment, since the recess 44 is defined in the upper portion of the driving side shaft bearing 42, the supply and take-up spools 1, 3 can preferably be set in the cartridge casing 41 while they are being held in a vertically aligned arrangement. However, the recess 44 may not be limited to such an upper position on the driving side shaft bearing 42, but may be positioned anywhere in the outer circumferential surface of the driving side shaft bearing 42 which extends about the center of the bearing hole 42*a*, as shown in FIG. 28.

The driving side shaft bearing 42 may not be limited to the above structural details, but may be of any structure insofar as the driving side shaft bearing 42 has a portion that is spaced from the circumferential edge of the bearing hole 42*a* by a distance which is greater than the distance "d" between the closest outer circumferential surfaces of the driving side shafts 6, 7 of the fastened ink ribbon unit 10, and a portion that is spaced from the circumferential edge of the bearing hole 42*a* by a distance which is substantially equal to or greater than the distance "d". The shape of the latter portion is not limited to a recess shape.

Figure 29:
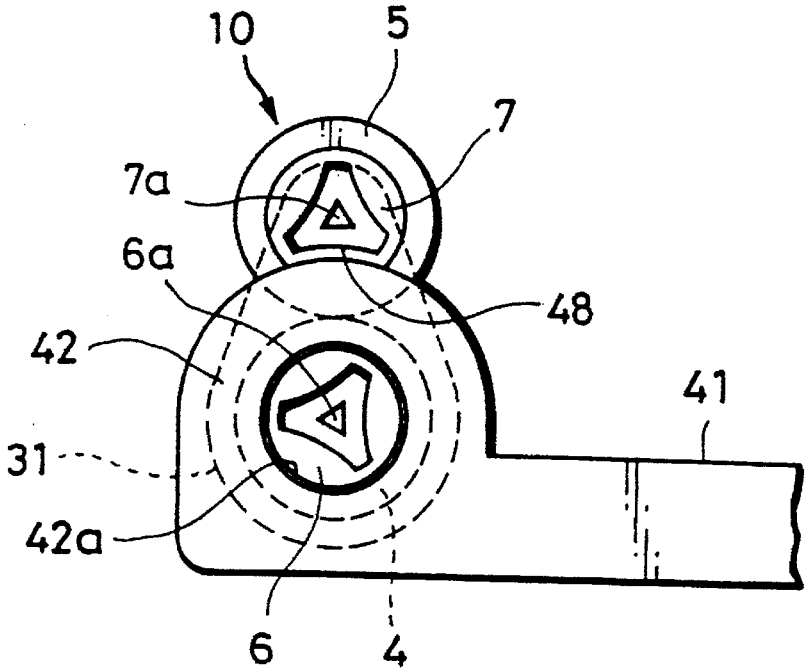
FIG. 29 is a fragmentary front elevational view of the ink ribbon cartridge loaded with another ink ribbon unit according to the present invention.

FIG. 29 shows the ink ribbon cartridge loaded with another ink ribbon unit according to the present invention. As shown in FIG. 29, the ink ribbon unit includes a driving side shaft 7 having recesses 48 defined in its outer circumferential surface and each complementary in shape to a portion of the outer circumferential surface of the driving side shaft bearing 42. With the arrangement shown in FIG. 29, the driving side shaft 7 does not overlap and interfere with the driving side shaft bearing 42, allowing the driving side shaft 6 to be aligned with and inserted into the bearing hole 42*a*. The driving side shaft 7 has a substantially triangular drive hole 7*a* defined in its end for receiving a substantially triangular driving side shaft in a printer.

In the above embodiments, the driving side shaft 6 of the supply spool 1 is first inserted into the driving side shaft bearing 42. However, if the driving side shaft 7 of the take-up spool 3 is to be first inserted into the driving side shaft bearing 43, then the recess 44 may be defined in the driving side shaft bearing 43 as shown in FIG. 27 or FIG. 28, or alternatively, the recesses 48 may be defined in the driving side shaft 6 as shown in FIG. 29.

In the fifth embodiment, a driving side shaft bearing of the cartridge casing has a portion or recess that is spaced from the circumferential edge of the bearing hole by a distance which is-equal to or smaller than the distance between the outer circumferential surfaces of the driving side shafts of the ink ribbon unit. Therefore, while the supply and take-up spools of the ink ribbon unit are fastened by the holder, the corresponding driving side shaft can easily be inserted into the driving side shaft bearing.

Since the recess is of an arcuate shape having a radius of curvature that is greater than the radius of the driving side shaft, when the driving side shaft of one of the spools is inserted into the driving side shaft bearing, the driving side shaft of the other spool can easily be positioned in the recess.

The principles of the present invention are also applicable to fastening and locking ink ribbon units against free rotation for video printers and other printers.

Having described preferred embodiments of the invention with reference to the accompanying drawings, it is to be understood that the invention is not limited to those precise embodiments and that various changes and modifications could be effected by one skilled in the art without departing from the spirit or scope of the invention as defined in the appended claims.

What is claimed is:

1. An ink ribbon unit comprising:

a supply spool with an unused ink ribbon wound thereon, said supply spool having a driving side shaft on an end thereof, a rotary side shaft on an opposite end thereof, a take-up spool for winding a used ink ribbon supplied from said supply spool, said take-up spool having a driving side shaft on an end thereof, a rotary side shaft on an opposite end thereof; and means to hold said supply spool and said take-up spool parallel to each other, and to fasten and lock said supply spool and said take-up spool against free rotation, said means including a sheet-like elastic holder for surrounding said supply spool and said take-up spool around an outer surface of the unused ink ribbon wound on said supply spool, said holder having free ends; and joint means for securing said free ends of said holder.

2. An ink ribbon unit according to claim 1, wherein said joint means comprises an adhesive tape for joining the free ends of said holder to each other.

3. An ink ribbon unit according to claim 1, wherein said joint means comprises a hook disposed on said holder near the respective free ends thereof, and a looped rubber member to be expanded and engaged with the hook.

4. An ink ribbon unit according to claim 1, wherein said joint means comprises an extension from one of the free ends of said holder and a curled engaging member on an end of said extension for engaging with a curved area of said holder.

5. An ink ribbon unit according to claim 4, wherein said holder has a cut-off region including a severance line extending across said holder.

6. An ink ribbon unit according to claim 1, wherein said joint means comprises a web integral with and extending from one of the free ends of said holder, and a hook disposed on said holder near the other of the free ends thereof for fitting into an engaging hole defined in said web.

7. An ink ribbon unit according to claim 1, wherein said joint means comprises an engaging hole defined in one of the free ends of said holder, and a hook bent back from the other of the free ends of said holder for fitting into said engaging hole.

8. An ink ribbon unit according to claim 1, wherein said holder comprises an elastic member having a fixed shape for covering said supply spool and said take-up spool.

9. An ink ribbon unit according to claim 1, wherein said holder is formed by vacuum forming.

* * * * *